US005923930A

United States Patent [19]

Tsukamoto et al.

[11] Patent Number: 5,923,930

[45] Date of Patent: Jul. 13, 1999

[54] APPARATUS FOR CONTROLLING DENSITY OF LIQUID DEVELOPING SOLUTION AND APPARATUS FOR FORMING IMAGES

[75] Inventors: Takeo Tsukamoto; Makoto Obu; Hideki Kosugi; Mie Yoshino; Sadayuki Iwai, all of Kanagawa, Japan

[73] Assignee: Ricoh Company, Ltd., Tokyo, Japan

[21] Appl. No.: 09/017,924

[22] Filed: Feb. 3, 1998

[30] Foreign Application Priority Data

| | | | |
|---|---|---|---|
| Feb. 4, 1997 | [JP] | Japan | 9-035592 |
| Feb. 5, 1997 | [JP] | Japan | 9-037000 |
| Jan. 21, 1998 | [JP] | Japan | 10-023943 |

[51] Int. Cl.[6] ..... G03G 15/10

[52] U.S. Cl. ..... 399/237

[58] Field of Search ..... 399/237, 58, 57; 430/117, 112

[56] References Cited

U.S. PATENT DOCUMENTS

| | | | |
|---|---|---|---|
| 4,796,051 | 1/1989 | Monkelbaan et al. | 399/237 X |
| 5,652,080 | 7/1997 | Yoshino et al. . | |
| 5,666,616 | 9/1997 | Yoshino et al. . | |
| 5,708,938 | 1/1998 | Takeuchi et al. . | |

*Primary Examiner*—S. Lee

*Attorney, Agent, or Firm*—Oblon, Spivak, McClelland, Maier & Neustadt, P.C.

[57] ABSTRACT

A density regulating apparatus includes a rotatable container for containing developing liquid and a rotating unit for rotating the container. The rotatable container when rotated generates a centrifugal force exerted on the developing liquid contained in the container so as to separate the developing liquid into a plurality of portions.

25 Claims, 22 Drawing Sheets

APPARATUS FOR CONTROLLING DENSITY OF LIQUID DEVELOPING SOLUTION AND APPARATUS FOR FORMING IMAGES

BACKGROUND OF THE INVENTION

1. Field of the Invention

The present invention generally relates to density regulating apparatus for developing liquid for use in image forming apparatuses such as a copying machine, a facsimile machine, a printer and the like. The present invention relates more particularly to a density regulating apparatus for regulating a density (solid content density) of developing liquid so that a predetermined density level is attained, without supplementing developing liquid, and also to an image forming apparatus provided with such a density regulating apparatus.

2. Description of the Related Art

Various types of image forming apparatuses are known in which developing liquid formed as dispersion of toner particles (solid content) in carrier liquid is used, in order to develop a latent image and form a toner image on a surface of a recording member.

FIG. 1 is a front view showing a schematic construction of an image forming apparatus in which high-density developing liquid is used. Since the high-density developing liquid has a significantly high toner particle density, the developing liquid as a whole has a high viscosity (100–10000 mPa•s) even when the carrier liquid is low in viscosity. Generally, in an image forming apparatus in which high-density developing liquid is used, a pre-wet process whereby a pre-wet film is formed on a photosensitive object (a latent image carrying object) by applying a pre-wet liquid on the photosensitive object, in order to prevent the background of the image from being soiled.

Referring to FIG. 1, high-density developing liquid 20 in a developing liquid tank 21 is supplied to the surface of a developing belt 2 via the surfaces of a series of developing liquid applying rollers 22*a*, 22*b* and 22*c*. In this process, the developing liquid is transformed into a thin film so that a developing liquid film having a regular thickness is formed on the developing belt 2.

Transparent pre-wet liquid is applied by the pre-wet roller 6 to the surface of a photosensitive drum 1. An electrostatic latent image is formed on the surface of the photosensitive drum 1 uniformly charged by a charging roller 7. The latent image is developed by the developing liquid film on the developing belt 2. The developed image on the photosensitive drum is transferred to paper 8 (recording member) fed to a position opposite to the photosensitive drum 1. The paper 8 having the image transferred thereto passes between the photosensitive drum 1 and a transfer roller 3 and reaches a fixing unit (not shown) so that the image is fixed. The paper 8 is then ejected outside the apparatus.

When the image has been transferred to the paper 8, the photosensitive drum 1 has toner remaining thereon raked off by a cleaning blade 4. A discharging lamp 5 initializes the photosensitive drum 1 by removing the charge remaining thereon. The developing liquid that remains on the surface of the developing belt 2 past an area where a developing process occurs is raked off by a collecting blade 23 so that the developing belt 2 is initialized. The developing liquid past a development area is drawn in by a pump 24 so as to be returned to developing liquid tank 21 via a developing liquid drain passage 25. The developing liquid returned to the developing liquid tank 21 is re-used.

The toner in the developing liquid is partially consumed as a result of the developing process. In addition, if the pre-wet liquid has the same content as the carrier liquid, the developing liquid and the pre-wet liquid are mixed with each other so that the developing liquid past the development area has the pre-wet liquid mixed therein. Accordingly, the toner density of the developing liquid past the development area is lower than the toner density required in the developing process (hereinafter, the toner density required in the developing process will be referred to as a predetermined toner density). Accordingly, if the developing liquid past the developing area is returned as it is to the developing liquid tank 21 for re-use, the density of the image formed on the paper 8 is decreased.

According to one conventional approach, decrease in the density of the image is prevented by providing a density sensor 26 for detecting a toner density of the developing liquid 20 in the developing liquid tank 21, and a high-density developing liquid tank 27 for containing developing liquid having a higher toner density than the predetermined toner density. The density sensor 26 is designed to detect a decrease in the toner density of the developing liquid 20 in the developing liquid tank 21. By supplementing the high-density developing liquid of the high-density developing liquid tank 27 to the developing liquid tank 21 appropriately, the toner density of the developing liquid is maintained at a constant level.

Referring to FIG. 1, also connected to the developing liquid tank 21 so as to be located side-by-side with respect the high-density developing liquid tank 27 is a carrier liquid tank 28 for retaining the carrier liquid. For example, when dust or the like is mixed in the developing liquid 20 in the developing liquid tank 21, the developing liquid is discarded so that the developing liquid tank 21 is supplied with the high-density developing liquid from the high-density developing liquid tank 27 and with the carrier liquid from the carrier liquid tank 28, with a mixture ratio controlled to achieve the predetermined toner density.

FIG. 2 is a front view showing a schematic construction of an image forming apparatus in which a low-density developing liquid having a viscosity of 100 mPa•s or below is used. Like the image forming apparatus of FIG. 1 in which the high-density developing liquid is used, the image forming apparatus of FIG. 2 is constructed such that the developing liquid on the developing roller 2 past the development area and having a reduced toner density as a result of the developing process is returned to the developing tank 21. When the density sensor 26 detects a decrease in the toner density of the developing liquid 20 in the developing tank 21, the high-density developing liquid tank 27 supplies the high-density developing liquid to the developing tank 21 so that the toner density is maintained at a constant level. A squeeze roller 9 may be used to remove the leftover carrier liquid (rarefied developing liquid) past the development area on the surface of the photosensitive drum 1.

However, the image forming apparatus in which high-density developing liquid is used and the image-forming apparatus in which low-density developing liquid is used as described above have a drawback in that the volume of the developing liquid in the developing tank 21 continues to increase as a result of the high-density developing liquid being supplied to the developing liquid tank 21 in order to prevent the toner density of the developing liquid in the developing liquid tank 21 from being decreased, causing an overflow of the developing liquid in the developing liquid tank 21.

The aforementioned drawback is particularly serious in an image forming apparatuses in which low-density developing liquid is used and in which leftover carrier liquid (rarefied developing liquid) past the development area on the surface of the photosensitive drum 1 is removed by the squeeze roller 9 so as to be returned to the developing liquid tank 21. Since a large quantity of high-density developing liquid should be supplemented to the developing liquid tank 21 in this construction, an overflow of the developing liquid is likely to occur at a relatively short interval.

Once conceivable approach to eliminate the above-described drawback is to increase the toner density of the developing liquid in the high-density developing liquid tank 27 so that the quantity of the developing liquid supplemented to the developing liquid tank 21 is reduced, while ensuring that a proper developing performance is not lost. However, while such an approach is useful to extend a period of time required for an overflow to occur, it cannot prevent the volume of the developing liquid in the developing tank 21 from being continually increased.

SUMMARY OF THE INVENTION

Accordingly, an object of the present invention is to provide density regulating apparatuses and image forming apparatuses in which the aforementioned drawbacks are eliminated.

Another and more specific object of the present invention is to provide a density regulating apparatus for a developing liquid and an image forming apparatus having the same whereby it is possible to regulate the toner density of the developing liquid to maintain it at a predetermined level with no or reduced amount of developing liquid supplement.

The aforementioned objects can be achieved by a density regulating apparatus for regulating a density of developing liquid containing toner particles and carrier liquid for carrying the toner particles, comprising: a rotatable container for containing the developing liquid; and a rotating unit for rotating the container, wherein the container when rotated generates a centrifugal force exerted on the developing liquid contained in the container.

Generally, the toner particles have a larger specific gravity than the liquid carrier so that the developing liquid contained in the rotated container according to the invention is separated into the high-density developing liquid and the low-density developing liquid, resulting in a developing liquid density distribution where the density is lower near the center of rotation and higher away from the center. Thus, the low-density developing liquid near the center of rotation of the container and/or the high-density developing liquid away from the center may be collected by suction. The density of the developing liquid collected varies depending on the conditions such as the inner diameter of the container and the revolution. Thus, it is possible to collect the developing liquid of a desired density by varying the conditions.

Accordingly, it is possible to regulate the toner density of the developing liquid to maintain it at a predetermined level with no or reduced amount of developing liquid supplement.

With the use of the density regulating apparatus of the invention, it is ensured that a relatively long period of time elapses before an overflow of the developing liquid from the developing liquid tank occurs. Further, by regulating the density appropriately, it is possible to prevent an overflow from occurring. When applied to the image forming apparatus using high-density developing liquid, the density regulating apparatus enables re-use of the developing liquid past a development area so that recycling of the developing liquid is established in the image forming apparatus.

The container may comprise a hollow cylindrical part, a front end plate and a rear end plate, the front end plate and the rear end plate closing the hollow cylindrical part.

According to this aspect of the invention, the load imposed on the developing liquid density regulating tank is controlled to a minimum level when the developing liquid density regulating tank is rotated around an axis of rotation of the cylindrical configuration. Thus, the developing liquid density regulating tank can be rotated at a high speed so that separation can be performed efficiently.

An inlet through which the developing liquid is introduced into the container may be provided so as to be aligned with a rotation axis of the container.

According to this aspect of the invention, the position of the inlet remains unchanged during the rotation of the container. Without this feature, a complex joint structure for not preventing the rotation of the container may be necessary at an inlet of the container.

An outlet through which the developing liquid is drained out of the container may be provided so as to be aligned with a rotation axis of the container.

According to this aspect of the invention, the position of the outlet remains unchanged during the rotation of the container. Without this feature, a complex joint structure for not preventing the rotation of the container may be necessary at an outlet of the container.

An opening through which the toner particles pass may be provided in the hollow cylindrical part of the container.

According to this aspect of the invention, the high-density developing liquid drawn to the inner wall of the hollow cylindrical part is splashed outside via the openings as the container is rotated. Thus, the high-density developing liquid is collected using a simple construction.

The hollow cylindrical part may be formed of an elastic member provided with a plurality of incisions which produce respective openings when a predetermined elastic force is applied perpendicularly to the surface of the hollow cylindrical part, each of the openings having a size sufficient for the developing liquid to pass through.

According to this aspect of the invention, the high-density developing liquid can be collected using a simple construction.

If the openings or the incisions produced when the container is rotated are undesirably large, the developing liquid near the inner wall of the hollow cylindrical part is splashed out of the container via the openings or the incisions before a density distribution in relation to the radius from the center of the rotation is produced, preventing the high-density developing liquid from being collected properly. The desirable size of the openings and the incisions produced when the container is rotated, necessary to collect the desired high-density developing liquid, may vary depending on the inner diameter and revolution of the container, the material forming the hollow cylindrical part, and the like. Thus, by configuring the conditions properly, the developing liquid having a desired density is collected.

The aforementioned objects can also be achieved by a density regulating apparatus for regulating a density of developing liquid containing toner particles and carrier liquid for carrying the toner particles, comprising: a pair of electrode plates provided so as to be opposite to each other and producing a potential difference in a gap between the pair of electrode plates, at least one of the pair of electrode plates being provided with conductivity and with a plurality of minute openings through the developing liquid passes, wherein the developing liquid is supplied to the gap between the pair of electrode plates.

According to this aspect of the invention, assuming that the solid content in the developing liquid is positively charged, the solid content is attracted to the electrode plate at a lower potential so that the solid content density of the developing liquid near the low-potential electrode plate increases and the solid content density of the developing liquid near the high-potential electrode plate decreases. If the solid content in the developing liquid is negatively charged, the solid content is attracted to the electrode plate at a higher potential so that the solid content density of the developing liquid near the high-potential electrode plate increases and the solid content density of the developing liquid near the low-potential electrode plate decreases. According to this mechanism, the developing liquid supplied to a gap between the pair of electrode plates is separated into the high-density developing liquid and the low-density developing liquid. The developing liquid drawn to the electrode plate having the openings is collected via the openings due to pressure caused by a liquid flow of the developing liquid between the pair of electrode plates.

The solid content density of the developing liquid collected via the openings of the electrode plate depends on conditions including the size of the openings, the surface area of the electrode plate, the voltage applied to the electrode plate, and the speed of the flow of the developing liquid supplied to the gap between the pair of electrodes. Thus by controlling the conditions properly, the developing liquid supplied to the gap between the pair of electrodes can be separated into the high-density developing liquid and the low-density developing liquid each having a desired solid content density.

A negative pressure with respect to a pressure occurring in the gap may be applied to a surface of the at least one of the pair of electrode plates provided with conductivity and with the plurality of minute openings which surface is opposite to a surface facing another of the pair of electrode plates.

According to this aspect of the invention, outflow of the developing liquid drawn to the electrode plate having the openings is facilitated. Thus, the developing liquid is efficiently collected.

The negative pressure may be simultaneously applied to the surface in a plurality of areas produced by segmenting the-density regulating apparatus in a direction perpendicular to a direction in which the developing liquid flows.

The distribution of the solid content density of the developing liquid across the electrode plates varies depending on the location in the direction of the flow of the developing liquid. More specifically, at an upstream location where the developing liquid flows into a gap between the electrode plates, the solid content density of the developing liquid is uniform across the electrode plates. At a downstream location, however, a high-density portion zone and a low-density zone exist across the electrode plates. Accordingly, by providing negative pressure at a plurality of areas along the direction of the flow, and by collecting the developing liquid from a combination of the areas, the developing liquid having a desired solid content density is collected. When applied to an image forming apparatus using high-density developing liquid, the density regulating apparatus according to the above aspect facilitates establishing recycling of the developing liquid in the image forming apparatus.

The aforementioned objects can also be achieved by an image forming apparatus comprising: latent image carrying means; latent image forming means for forming a latent image on the latent image carrying means; developing liquid carrying means carrying a developing liquid containing toner particles and carrier liquid and transferring the developing liquid to the latent image carrying object having the latent image formed thereon; collecting means for collecting the developing liquid from the developing liquid carrying object past a zone opposite to the latent image carrying object; and separating means for separating the developing liquid collected by the collecting means into a first portion and a second portion, the first portion containing one of relatively high-density developing liquid and genuine toner particles, and the second portion containing one of relatively low-density developing liquid and genuine carrier liquid.

According to the image forming apparatus of the invention, the developing liquid is separated properly and collected for re-use. Therefore, an image forming operation can continue with no or reduced of developing liquid supplemented.

The separating means may include an electrodeposition unit for causing the toner particles in the developing liquid to be aggregated on a surface of a member in contact with the developing liquid collected by the collecting means.

The aforementioned objects can also be achieved by an image forming apparatus comprising: latent image carrying means; latent image forming means for forming a latent image on the latent image carrying means; developing liquid carrying means carrying a developing liquid containing toner particles and carrier liquid and transferring the developing liquid to the latent image carrying object having the latent image formed thereon; and separating and collecting means for separating the developing liquid on the developing liquid carrying means past a zone opposite to the latent image carrying means into a first portion and a second portion, the first portion containing one of relatively high-density developing liquid and genuine toner particles, and the first portion containing one of relatively low-density developing liquid and genuine carrier liquid, and for collecting at least one of the first portion and the second portion.

The separating and collecting means may include an electrode member provided so as to be opposite to the developing liquid carrying means past the zone opposite to the latent image carrying means and having a predetermined potential applied thereto, and an electric field generated between the electrode member and the developing liquid carrying means may be exerted on the developing liquid on the developing liquid carrying means so as to separate the developing liquid into the first and second portions.

The separating and collecting means may include a particle aggregating means for causing the toner particles in the developing liquid on the developing liquid carrying means past the zone opposite to the latent image carrying means to be aggregated on a surface of the developing liquid carrying means.

The aforementioned objects can also be achieved by an image forming apparatus comprising: latent image carrying means; latent image forming means for forming a latent image on the latent image carrying means; developing means for supplying developing liquid contained in a developing liquid containing part and including toner particles and carrier liquid, to the latent image carrying means on which the latent image is formed, so as to develop the latent image, and for collecting the developing liquid past a zone opposite to the latent image carrying means to the developing liquid containing part for re-use; at least one of a prescribed-density developing liquid containing tank for retaining developing liquid having the same solid content density as a desired solid content density of the developing liquid, a low-density developing liquid containing tank for containing developing liquid having a lower solid content density than the desired solid content density, a high-density developing liquid containing tank for containing developing liquid having a higher solid content density than the desired solid content density, and a carrier liquid containing tank for containing the liquid carrier; liquid supply means for supplying liquid contained in the at least one of the prescribed-density developing liquid containing tank, the low-density developing liquid containing tank, the high-density developing liquid containing tank, to the developing liquid containing part; separating and supplying means for separating the developing liquid past the zone opposite to the latent image carrying means into a first portion and a second portion, the first portion containing one of relatively high-density developing liquid and genuine toner particles, and the second portion containing one of relatively low-density developing liquid and genuine liquid carrier, and for supplying at least one of the first portion and the second portion to a respective one of the prescribed-density developing liquid containing tank, the low-density developing liquid containing tank, the high-density developing liquid containing tank and the liquid carrier containing tank.

The separating and supplying means may include a rotatable container for containing the developing liquid past the zone opposite to the latent image carrying means, and the container when rotated may generate a centrifugal force exerted on the developing liquid inside and causing the developing liquid to be separated into first and second portions.

The separating and supplying means may include a pair of electrode members provided so as to be opposite to each other and having a predetermined potential applied thereto so as to produce an electric field between the pair of electrode plates, and the developing liquid past the zone opposite to the latent image carrying means may be supplied to a gap between the pair of electrode members so that the electric field exerted on the developing liquid separates the developing liquid into the first and second portions.

The separating and supplying means may include a particle aggregating unit for aggregating the toner particles in the developing liquid on a surface of a member in contact with the developing liquid past the zone opposite to the latent image carrying means.

At least two of the prescribed-density developing liquid containing tank, the low-density developing liquid containing tank, the high-density developing liquid containing tank and the carrier liquid containing tank may be provided, and the liquid supply means may be constructed such that supply from the at least two of the prescribed-density developing liquid containing tank, the low-density developing liquid containing tank, the high-density developing liquid containing tank and the carrier liquid containing tank, to the developing liquid containing part is controlled independently.

At least the high-density developing liquid containing tank and the low-density developing liquid containing tank may be provided, and the liquid supply means may be constructed so that the relatively high-density developing liquid is supplied to the high-density developing liquid containing tank and the relatively low-density developing liquid is supplied to the low-density developing liquid.

At least the high-density developing liquid containing tank, the low-density developing liquid containing tank and the carrier liquid containing tank may be provided, the developing liquid past the zone opposite to the latent image carrying means may be separated into the relatively high-density developing liquid, the relatively low-density developing liquid and the genuine liquid carrier, and the liquid supply means may be constructed so that the relatively high-density developing liquid is supplied to the high-density developing liquid containing tank, the relatively low-density developing liquid is supplied to the low-density developing liquid containing tank, and the genuine liquid carrier is supplied to the liquid carrier containing tank.

The prescribed density developing liquid containing tank may be provided, a detection unit for detecting an amount of developing liquid contained in the developing liquid containing part may be coupled to the developing liquid containing tank, and the liquid supply means may be constructed such that supply from the prescribed-density developing liquid containing tank to the developing liquid containing part is controlled in accordance with a result of detection by the detection unit.

According to this aspect of the invention, the developing liquid having a desired solid content density is supplied from the prescribed-density developing liquid containing tank to the developing liquid containing part when the amount of developing liquid therein drops. This has a benefit of lessening requirements for churning the developing liquid in the developing liquid containing part as compared to a construction where the carrier liquid or the developing liquid having a solid content density different from the desired solid content density is supplied to the developing liquid containing part in order to maintain the volume of the developing liquid. Therefore, a churning device having a reduced performance may be used or the size of the developing liquid containing part may be reduced. It is to be noted that when the carrier liquid or the developing liquid having a solid content density different from the desired solid content density is supplied to the developing liquid containing part, and when the developing liquid containing part is relatively large, the supply of the liquid seriously affects the uniformity of the solid content density distribution in the developing liquid containing part so that the requirement for churning subsequent to the supply is relatively serious.

In further accordance with the above aspect of the invention, the solid content density and viscosity of the developing liquid in the developing liquid containing part change less remarkably than in a construction where the carrier liquid or the developing liquid having a solid content density different from the desired solid content density is used. As a result of this, variation in the image quality due to such a change is small while a series of prints are being made.

The aforementioned objects can also be achieved by an image forming apparatus comprising: latent image carrying means; latent image forming means for forming a latent image on the latent image carrying means; developing means for supplying developing liquid contained in a developing liquid containing part and including toner particles and carrier liquid, to the latent image carrying means on which the latent image is formed, so as to develop the latent image, and for collecting the developing liquid past a zone opposite to the latent image carrying means to the developing liquid containing part for re-use; a high-density developing liquid containing tank for containing developing liquid having a higher solid content density than a desired solid content density of the developing liquid in the developing liquid containing part; a prescribed-density developing liquid containing tank for containing developing liquid having a solid content density closer to the desired solid content density than the developing liquid contained in the high-density developing liquid tank, or having a solid content density equal to the desired solid content density; and liquid supply means for independently supplying liquid contained in the high-density developing liquid containing tank and the prescribed-density developing liquid containing tank, to the developing liquid containing part.

According to this aspect of the invention, the solid content density and viscosity of the developing liquid in the developing liquid containing part is more efficiently restored to respective desired levels than when the developing liquid with a solid content density higher than the desired solid content density is used.

The background for efficient restoration will be described below.

Since the developing liquid containing part has a certain volume, restoration of the solid content density and viscosity immediately after a supply occurs only locally. It takes a certain period of time before a development process is performed using the developing liquid having the solid content density and the like thereof completely restored. The developing liquid is churned in the developing liquid containing part so as to restore the solid content density and the like in the entirety of the developing liquid containing part. The lower the solid content density of the developing liquid supplied for restoration, the larger the amount of liquid required to restore the solid content density by a predetermined level. The larger the volume of the developing liquid supplied for restoration, the larger the volume ratio of the developing liquid in the developing liquid containing part restored to the desired solid content density and viscosity immediately after the supply, requiring less time to churn the developing liquid until the entirety of the developing liquid in the developing liquid containing part is restored to the desired solid content density. For this reason, it is comparatively advantageous to use the developing liquid from the prescribed-density developing liquid tank characterized by a relatively low solid content density, in order to efficiently restore the solid content density and viscosity of the developing liquid used in a development process to a desired level.

Therefore, the invention according to the above aspect has an advantage in that a user may select a printing mode whereby the developing liquid from the prescribed-density developing liquid tank is used for density regulation, when a quick restoration to a desired solid content density is required. For example, such a mode may be selected when a series of prints are being made.

Even when a carrier liquid tank containing carrier liquid is provided for restoration, it is preferable that the developing liquid contained in the prescribed-density developing liquid tank is supplied to the developing liquid containing part when the volume of the developing liquid therein drops below a predetermined level, in order to maintain the volume of the developing liquid. In this way, the requirement for churning the developing liquid in the developing liquid containing part is not so harsh so that it is possible to use a churning device with a reduced performance or to reduce the size of the developing liquid containing part. Unlike a construction in which the carrier liquid or the developing liquid having a solid content density different from the desired solid content density is supplied to the developing liquid containing part in order to maintain the volume of the developing liquid, the invention according to the above aspect causes less change, as a result of the supply, in the solid content density and viscosity in the entirety of the developing liquid containing part. Accordingly, variation in the image quality due to such a change is small while a series of prints are being made.

When it is possible to provide a sufficiently long period of time for churning, or when it is not likely that the image quality varies, the liquid from the carrier liquid tank may be used for density regulation. More specifically, such an option may be selected when the image forming apparatus is in a stand-by status or a in a state immediately subsequent to a printing process.

It is preferable that, in addition to the high-density developing liquid tank and the prescribed-density developing liquid tank, the carrier liquid tank and the low-density developing liquid tank containing developing liquid having a solid content density lower than the desired solid content density are provided. Moreover, it is preferable that supply control parts are constructed so that the liquid in the four tanks is independently supplied to the developing liquid containing part.

BRIEF DESCRIPTION OF THE DRAWINGS

Other objects and further features of the present invention will be apparent from the following detailed description when read in conjunction with the accompanying drawings, in which.

DETAILED DESCRIPTION OF THE PREFERRED EMBODIMENTS

A description will now be given of a density regulating apparatus and an image forming apparatus according to a first embodiment of the present invention.

The density regulating apparatus according to the first embodiment is provided with a separation apparatus having a rotatable container for containing a developing liquid. When rotated, the rotatable container generates a centrifugal force in the developing liquid inside so as to separate the high-density developing liquid (or the genuine toner) from the low-density developing liquid (or the genuine liquid carrier).

Figure 1:
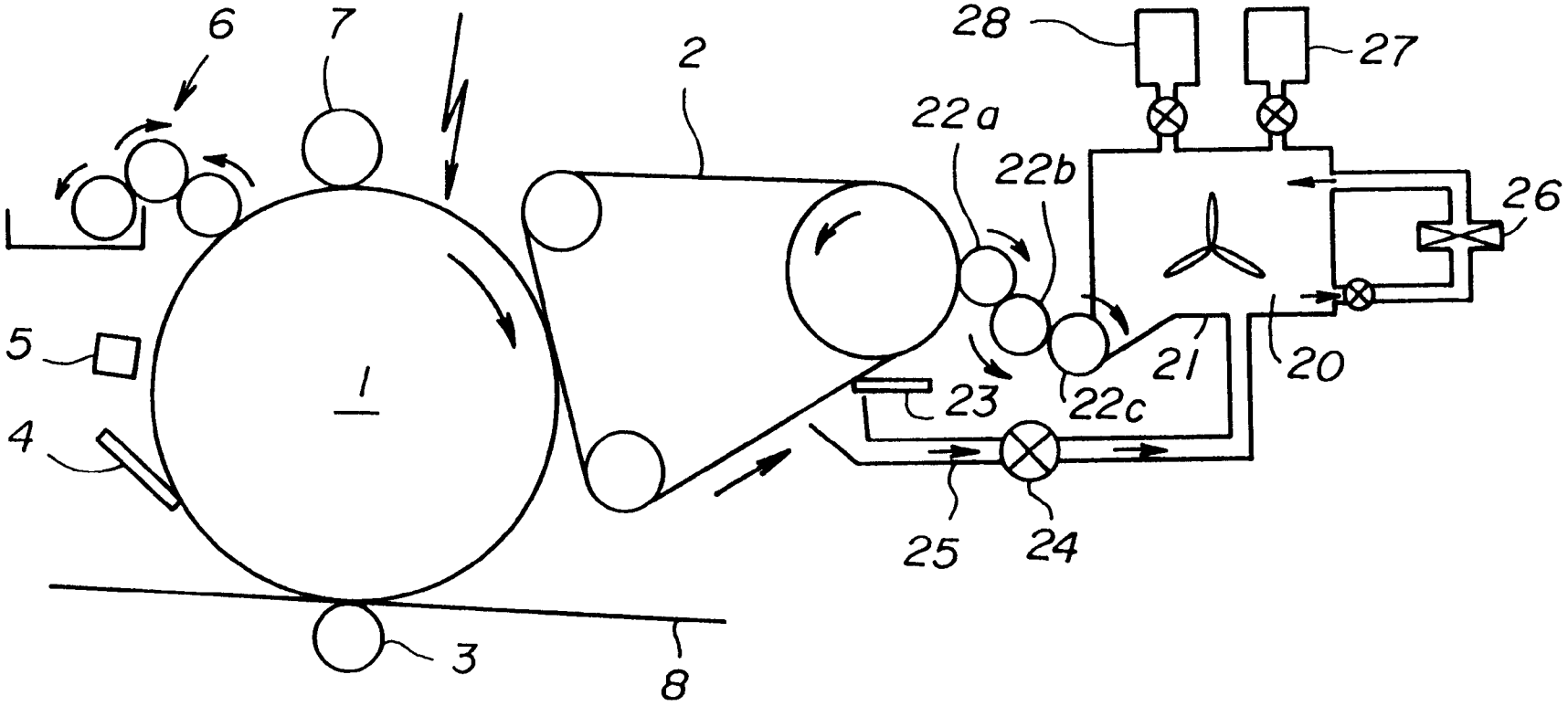
FIG. 1 PRIOR ART
FIG. 1 is a front view showing a schematic construction of an image forming apparatus in which high-density developing liquid is used.
Figure 3:
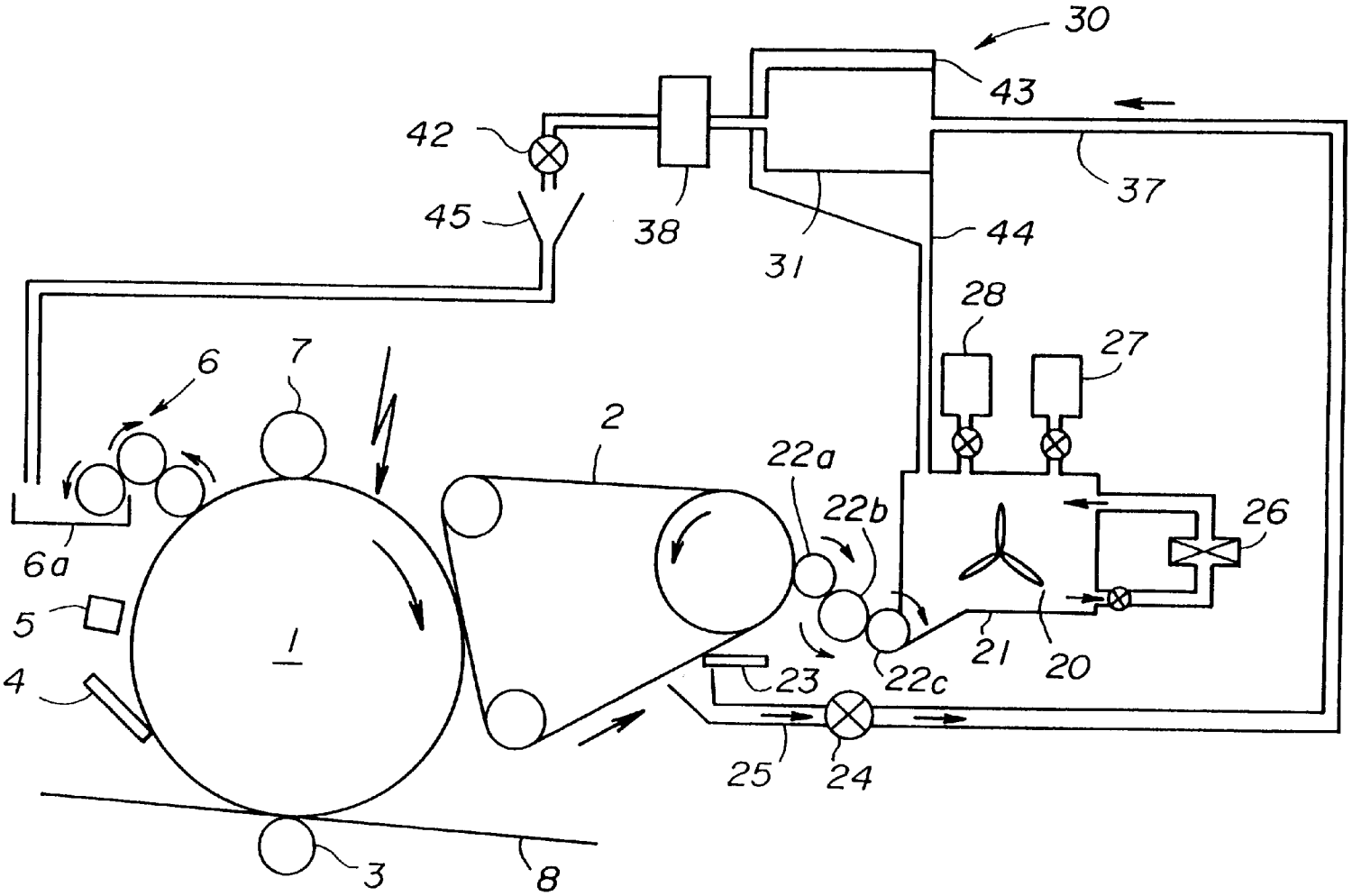
FIG. 3 is a front view showing a schematic construction of an image forming apparatus according to the invention.

FIG. 3 is a front view showing a schematic construction of the image forming apparatus according to the first embodiment. The construction of the image forming apparatus of FIG. 3 is similar to the construction as shown in FIG. 1, so that the description of like elements designated by like numerals is omitted. The image forming apparatus according to the first embodiment differs from the image forming apparatus of FIG. 1 in that a density regulating apparatus 30 having the separation apparatus as mentioned above is provided. By providing the separation apparatus, it is possible to regulate the toner density of the developing liquid to maintain it at a predetermined level without supplementing developing liquid.

Figure 4A:
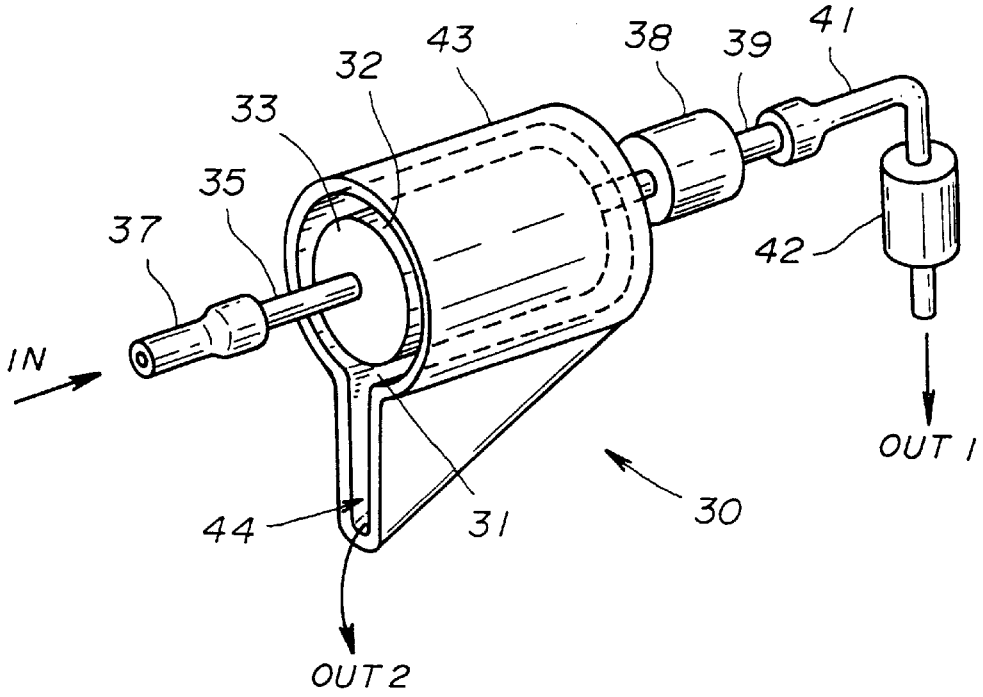
FIG. 4A is a perspective view showing a density regulating apparatus according to a first embodiment.
Figure 4B:
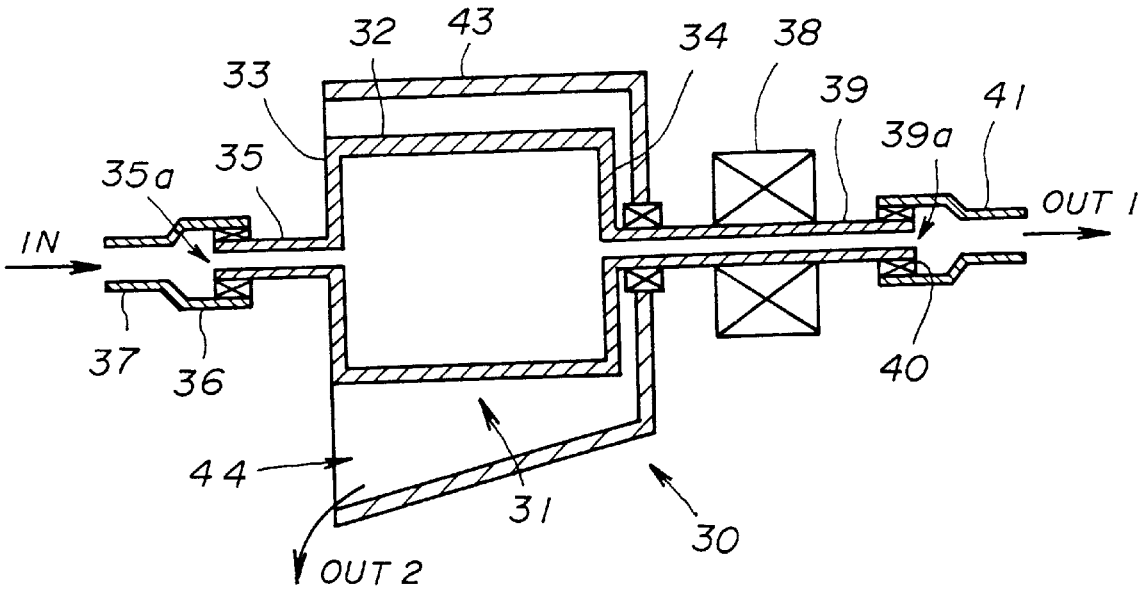
FIG. 4B is a sectional view of the density regulating apparatus according to the first embodiment.

FIG. 4A is a perspective view showing the density regulating apparatus 30 described above, and FIG. 4B is a sectional view of the density regulating apparatus 30. The density regulating apparatus 30 is provided with a developing liquid density regulating tank 31 having a sleeve 32, a front end plate 33 and a rear end plate 34, the front end plate 33 and the rear end plate 34 closing the sleeve 32 so as to leave no gap.

A joint pipe 35 is provided at the center of the front end plate 33 so as to communicate with the interior of the sleeve 32. The joint pipe 35 is provided with an inlet 35*a*. A developing liquid introducing passage 37 for introducing developing liquid into the developing liquid density regulating tank 31 is coupled to the inlet 35*a* via a bearing 36.

A joint pipe 39 is provided at the center of the rear end plate 34 so as to communicate with the interior of the sleeve 32. The joint pipe 36 is provided with an outlet 39*a*. A first developing liquid drain passage 41 for draining low-density developing liquid out of the sleeve 32 in a density regulating process to be described later is coupled to the outlet 39*a* via a bearing 40.

A motor 38 coupled to the joint pipe 39 simultaneously rotates the developing liquid density regulating tank 31, the front end plate 33, the rear end plate 34, the joint pipe 35 and the joint pipe 39 at a speed of, for example, 6000 rpm. Gears may be used to transmit the driving power of the motor 38.

The sleeve 32 is formed as a mesh or a filter with a fineness thereof controlled such that toner particles can just pass through the sleeve 32. When the developing liquid density regulating tank 31 is rotated at a high speed, high-density developing liquid is drawn to the inner wall of the developing liquid density regulating tank 31 as a result of the density regulating process to be described later and is splashed out of the developing liquid density regulating tank 31 via openings provided in the sleeve 32.

A stationary collecting tank 43 for collecting the high-density developing liquid splashed through the openings is provided to encircle the sleeve 32. A second developing liquid drain passage 44 for draining the collected high-density developing liquid is provided at a lower end of the collecting tank 43.

Figure 5:
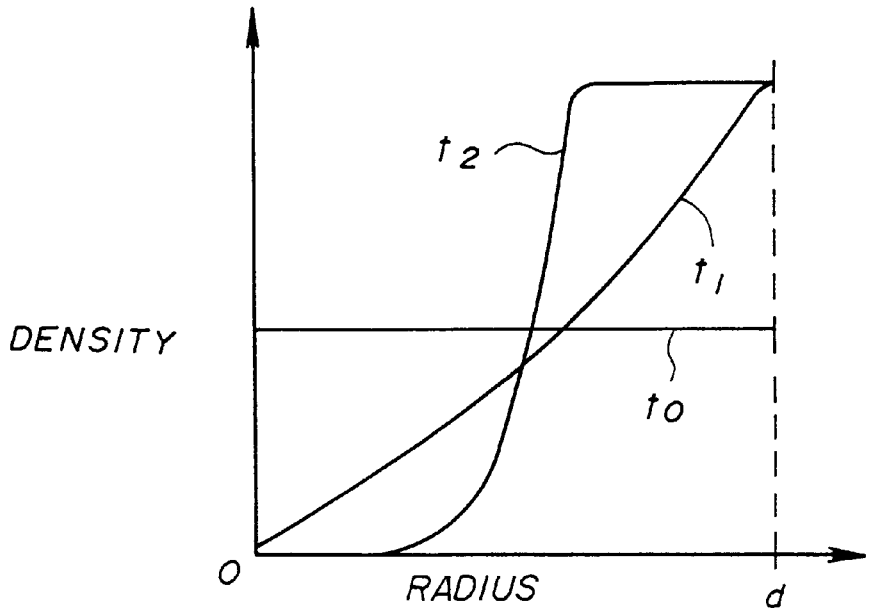
FIG. 5 is a graph obtained in our experiment, showing how the toner density of the developing liquid varies in relation to a radius from a center of rotation when a developing liquid density regulating tank is rotated at a high speed.

FIG. 5 is a graph obtained in our experiment, showing how the toner density of the developing liquid varies in relation to a radius from a center of rotation when the developing liquid density regulating tank 31 is rotated at a high speed. Referring to FIG. 5, t1 and t2 respectively indicate time elapsed from time t0 when the rotation of the developing liquid density regulating tank 31 is started, where t1<t2. The graph reveals that at time t0 when the developing liquid density regulating tank 31 starts rotating, the toner density of the developing liquid is uniform with respect to the radius. The graph also shows that, at time t1, and, more noticeably, at time t2, the toner density is lower near the center of rotation and higher near the inner wall of the developing liquid density regulating tank 31, due to an action of the centrifugal force. Such a toner density distribution is derived from a difference in specific gravity of the toner particles and the carrier liquid. For example, in the case of the high-density developing liquid used in our experiment, the specific gravity of the carrier liquid is approximately 1.0 and the specific gravity of the toner particles is approximately 1.3. This shows that it is possible to separate the developing liquid into low-density developing liquid and high-density developing liquid by exerting a centrifugal force on the developing liquid. When the rotation is halted after a sufficiently long period of time has elapsed from the start of the rotation of the developing liquid density regulating tank 31, the developing liquid inside retains the toner density distribution at time t2.

It is to be noted that the toner density of the developing liquid drained via the developing liquid drain passages 41 and 44 varies depending on the inner diameter of the developing liquid density regulating tank 31, the revolution thereof, the material forming the sleeve 32 and the configuration of the openings in the sleeve 32. By controlling these parameters, it is possible to collect only the carrier liquid via the first developing liquid drain passage 41 or to collect the developing liquid of a predetermined density via the second developing liquid drain passage 44. In the first embodiment, the parameters are controlled so that the developing liquid collected via the second developing liquid drain passage 44 has a predetermined toner density.

Referring back to FIG. 3, the image forming apparatus according to the first embodiment is constructed such that the developing liquid past the development area is introduced into the developing liquid density regulating tank 31 via the developing liquid introducing passage 37, and the developing liquid having the predetermined toner density and collected via the developing liquid drain passage 44 is returned to the developing liquid tank 21.

In the first embodiment, the density sensor 26, the high-density developing liquid tank 27 and the carrier liquid tank 28 retaining the carrier liquid to be supplemented to the developing liquid tank 21 are intended to constitute re-adjustment means for re-adjustment performed after the toner density regulation process performed by the density regulating apparatus 30. With this arrangement, the toner density of the developing liquid 20 in the developing liquid tank 21 is controlled more precisely than according to the related art. A signal indicating the density of the developing liquid obtained by the density sensor 26 may be fed back to the motor 38 so as to control the revolution of the developing liquid density regulating tank 31.

The image forming apparatus according to the first embodiment is also constructed such that the low-density developing liquid collected via the first developing liquid drain passage 41 is drawn in by a pump 42 and caused to pass through a filter 45 so that only the carrier contents are returned to a pre-wet liquid container 6*a* adjacent to the pre-wet roller 6. In this way, the developing liquid past the development area is re-used instead of being disposed of as a waste. Thus, recycling of the developing liquid in the image forming apparatus is established. Electrodeposition may be employed in place of the filter 45 to collect the carrier liquid.

The construction for re-use of the developing liquid past the development area may not be limited to the one as shown in FIG. 3. For example, the low-density developing liquid collected via the developing liquid drain passage 41 and the high-density developing liquid collected via the second developing liquid drain passage 44 may be mixed with each other appropriately so that the resultant developing liquid is returned to the developing liquid tank 21.

Figure 6A:
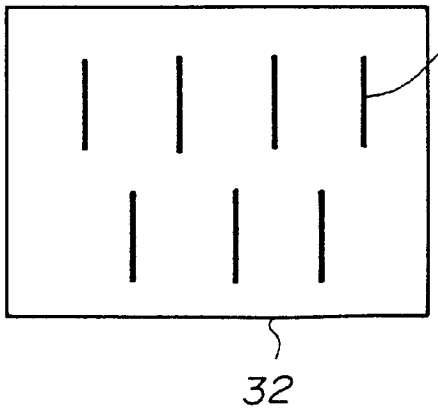
FIGS. 6A and 6B are expanded views showing a variation of a sleeve constituting the developing liquid density regulating tank.
Figure 6B:
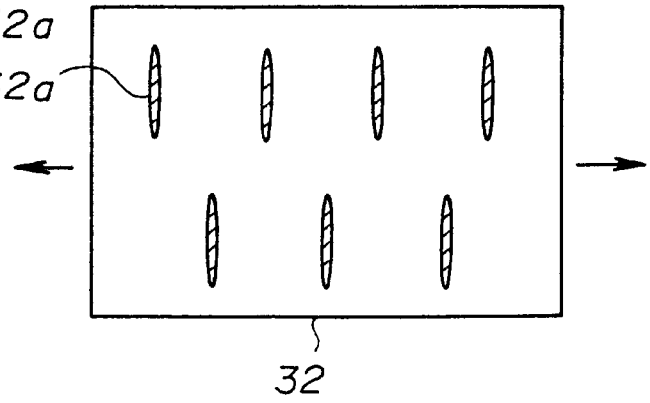
Figure 7A:
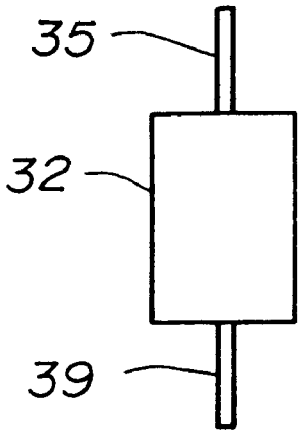
FIGS. 7A, 7B and 7C show how the developing liquid is collected via the sleeve.
Figure 7B:
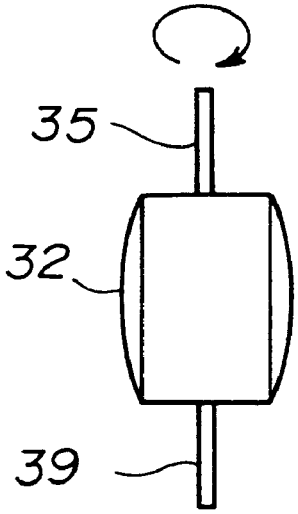
Figure 7C:
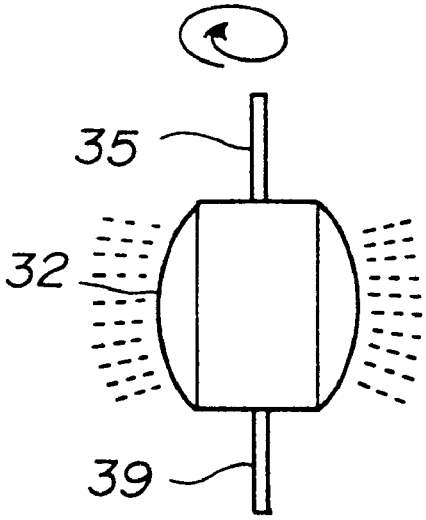

FIGS. 6A and 6B are expanded views showing a variation of the sleeve 32 constituting the developing liquid density regulating tank 31. The sleeve 32 according to the variation is formed of an elastic material such as hard rubber provided with a plurality of minute incisions 32*a*. As shown in FIG. 6A, the incisions 32*a* are closed when an external force is not exerted on the sleeve 32 and, as shown in FIG. 6B, turns into openings through which the developing liquid can pass when an elastic force exerted on the sleeve 32 reaches a predetermined level. FIGS. 7A, 7B and 7C show how the developing liquid is collected via the sleeve 32. When the developing liquid density regulating tank 31 is not rotated, as shown in FIG. 7A, the high-density developing liquid inside the developing liquid density regulating tank 31 is not splashed outside via the incisions 32*a*. When the developing liquid density regulating tank 31 is rotated but the elastic force on the sleeve 32 has not reached the predetermined level, as shown in FIG. 7B, the high-density developing liquid may be drawn to the inner wall of the developing liquid density regulating tank 31 but is not splashed outside via the incisions 32*a*. When the developing liquid density regulating tank 31 is rotated so that the elastic force on the sleeve 32 has reached the predetermined level, the high-density developing liquid near the inner wall of the developing liquid density regulating tank 31 is splashed outside via the incisions 32*a*.

As described above, according to the first embodiment, the toner density of the developing liquid past the development area is controlled by the density regulating apparatus 30 to have a predetermined density level before being returned to the developing tank 21. With this construction, the amount of developing liquid supplemented to the developing liquid tank 21 is significantly reduced. Accordingly, it is ensured that a far longer period of time elapses before an overflow of the developing liquid from the developing liquid tank 21 occurs. Further, by regulating the density appropriately, it is possible to prevent an overflow from occurring.

Since the developing liquid density regulating tank 31 is configured to be cylindrical, the load imposed on the developing liquid density regulating tank 31 is controlled to a minimum level when the developing liquid density regulating tank 31 is rotated around an axis of rotation of the cylindrical configuration. Therefore, the developing liquid density regulating tank 31 can be rotated at a high speed so that a desired density distribution of the developing liquid is obtained efficiently.

In further accordance with the first embodiment, the inlet 35*a* is aligned with the axis of rotation of the developing liquid density regulating tank 31 so that the position of the inlet 35*a* with respect to the developing liquid density regulating tank 31 remains unchanged when the developing liquid density regulating tank 31 is rotated. With a simple construction using the bearing 36, the developing liquid density regulating tank 31 and the developing liquid introducing passage 37 are joined to each other such that the rotation of the developing liquid density regulating tank 31 is not slowed down.

Further, the outlet 39*a* is aligned with the axis of rotation of the developing liquid density regulating tank 31 so that the position of the outlet 39*a* with respect to the developing liquid density regulating tank 31 remains unchanged when the developing liquid density regulating tank 31 is rotated. With a simple construction using the bearing 40, the developing liquid density regulating tank 31 and the first developing liquid drain passage 41 are joined to each other such that the rotation of the developing liquid density regulating tank 31 is not slowed down.

It is to be appreciated that, according to the first embodiment, the high-density developing liquid is collected using a simple construction by causing it to be splashed out of the rotated developing liquid density regulating tank 31 via the openings provided in the sleeve 32 of the developing liquid density regulating tank 31.

A description will now be given of a density regulating apparatus and an image forming apparatus according to a second embodiment of the present invention.

The density regulating apparatus according to the second embodiment is provided with a pair of electrode members. The developing liquid past a zone opposite to a latent image carrying object is caused to pass through the electrode members. An electric field generated between the electrode members by placing each of the electrode members to a predetermined potential is exerted on the developing liquid so that relatively high-density developing liquid (or the toner) and relatively low-density developing liquid (or carrier) are separated from each other.

Figure 8:
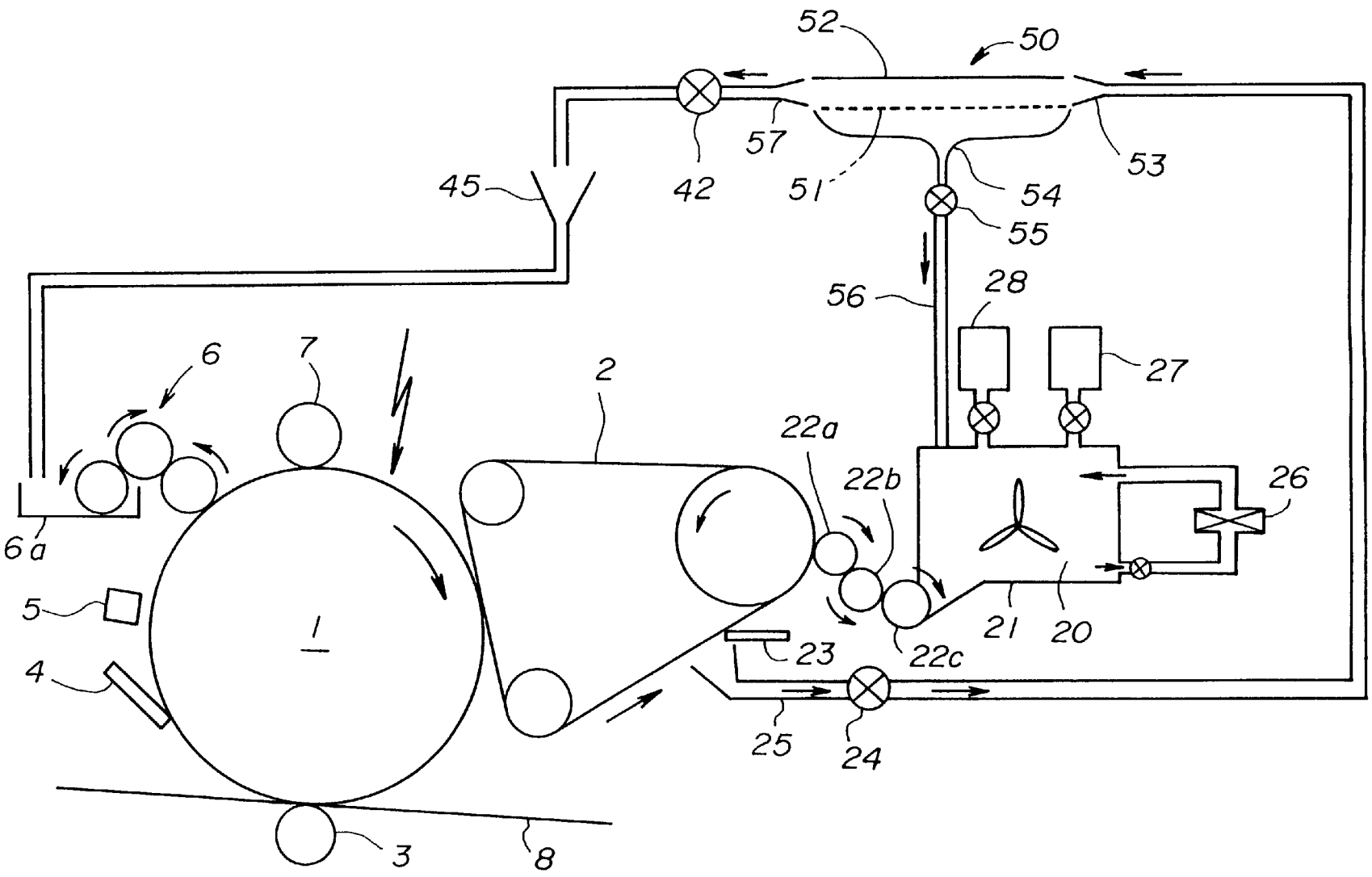
FIG. 8 is a front view showing a schematic construction of an image forming apparatus according to a second embodiment.

FIG. 8 is a front view showing a schematic construction of an image forming apparatus according to a second embodiment. The construction of the image forming apparatus of FIG. 8 is similar to the construction as shown in FIG. 1, so that the description of like elements designated by like numerals is omitted. The image forming apparatus according to the third embodiment differs from the image forming apparatus of FIG. 1 in that a density regulating apparatus 50 having a separation apparatus is provided. By providing the separation apparatus, it is possible to regulate the toner density of the developing liquid to maintain it at a predetermined level without supplementing developing liquid. A description will now be given of the density regulating apparatus 50.

Figure 9:
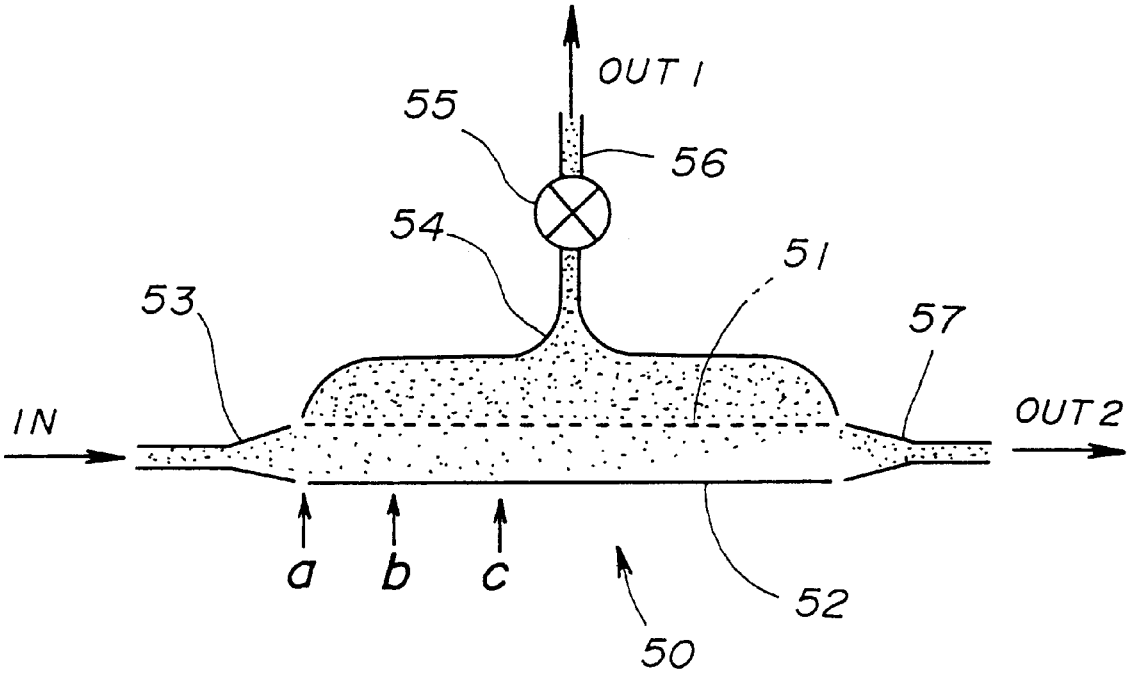
FIG. 9 shows a schematic construction of a density regulating apparatus according to the second embodiment.

FIG. 9 shows a schematic construction of the density regulating apparatus 50 according to the second embodiment. The density regulating apparatus 50 is constructed such that an electrode 51 formed as a mesh (hereinafter, simply referred to as a mesh electrode) and a plate electrode 52 are provided so as to be opposite to each other. The mesh electrode 51 is provided with a plurality of minute openings through which the developing liquid can pass. An electrode pair comprising the electrodes 51 and 52 is electrically conductive. A high-power supply (not shown) supplies a voltage to the electrodes 51 and 52.

In the following description, it is assumed that the toner particles are positively charged and the potential of the mesh electrode 51 is controlled to be lower than the potential of the plate electrode 52. With such an arrangement of the potentials, the toner particles are prevented from being built up on the inner wall of the plate electrode 52.

Referring to FIG. 9, a developing liquid supply passage 53 supplies the developing liquid to a gap between the mesh electrode 51 and the plate electrode 52. While flowing between the mesh electrode 51 and the plate electrode 52, the toner particles in the developing liquid are attracted to the mesh electrode 51 due to an electric field. As a result of this, the toner density of the developing liquid near the mesh electrode 51 becomes relatively high and the toner density of the developing liquid near the plate electrode 52 becomes relatively low.

Figure 10:
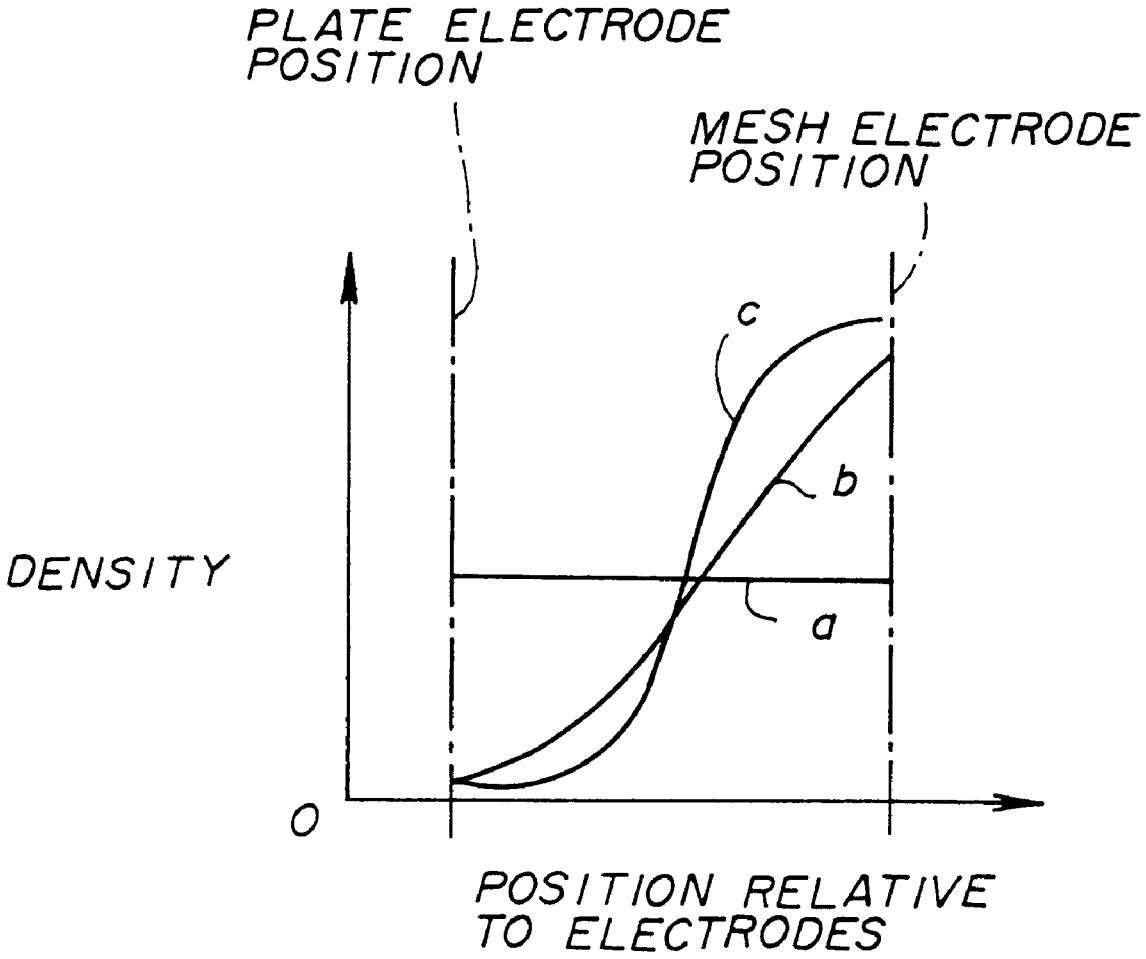
FIG. 10 is a graph showing how the toner density of the developing liquid varies with respect to positions relative to a mesh electrode and a plate electrode.

FIG. 10 is a graph showing how the toner density of the developing liquid varies with respect to positions relative to the mesh electrode 51 and the plate electrode 52. Curve a of FIG. 10 shows a toner density distribution that occurs at position a shown in FIG. 9, curve b of FIG. 10 shows a toner density distribution that occurs at position b shown in FIG. 9, and curve c of FIG. 10 shows a toner distribution that occurs at position c shown in FIG. 9. FIG. 10 reveals that the toner density of the developing liquid is uniform over a width of the gap between the electrodes, at position a where the developing liquid has just flowed into the gap between the electrodes. At downstream positions b and c, the toner is higher near the mesh electrode 51 and lower in the plate electrode 51.

Referring to FIG. 9, a first developing liquid collecting passage 56 is provided opposite to the back of the mesh electrode 51 not facing the plate electrode 52 so as to collect high-density developing liquid near the mesh electrode 51 via a chamber 54 and a pump 55. At a downstream extreme end of the gap between the electrodes 51 and 52 is provided with a second developing liquid collecting passage 57 for collecting low-density developing liquid obtained after the high-density developing liquid near the mesh electrode 51 has been collected.

The high-density developing liquid near the mesh electrode 51 is spontaneously filtered through the mesh electrode 51 as a result of a liquid flow that exists between the electrodes. However, for more efficient filtering, it is preferable that the chamber 54 is provided and the pump 55 is used to lower the pressure in the chamber 54, as is done in the second embodiment.

The toner density of the developing liquid collected via the first developing liquid collecting passage 56 and the toner density of the developing liquid collected via the second developing liquid collecting passage 57 vary depending on the conditions that such as the size of the openings in the mesh electrode 51, the surface area of the mesh electrode 51, the speed of the flow of the developing liquid supplied to the gap between the electrodes 51 and 52, the voltage applied to the electrodes 51 and 52 and so on. According to the second embodiment, the voltage applied to the electrodes 51 and 52 is controlled so that the toner density of the developing liquid collected via the first developing liquid collecting passage 56 is a predetermined density. As shown in FIG. 8, the developing liquid collected via the first developing liquid collecting passage 56 is returned to the developing tank 21.

In the second embodiment, the density sensor 26, the high-density developing liquid tank 27 and the carrier liquid tank 28 retaining the carrier liquid to be supplemented to the developing liquid tank 21 are intended to constitute re-adjustment means for re-adjustment performed after the toner density regulation process performed by the density regulating apparatus 50. With this arrangement, the toner density of the developing liquid 20 in the developing liquid tank 21 is controlled more precisely than according to the related art. A signal indicating the density of the developing liquid obtained by the density sensor 26 may be fed back as a density signal so as to control the voltage applied to the electrodes 51 and 52.

The image forming apparatus according to the second embodiment is also constructed such that the low-density developing liquid collected via the second developing liquid collecting passage 57 is drawn in by the pump 42 and caused to pass through the filter 45 so that only the carrier contents are returned to the pre-wet liquid container 6*a* adjacent to the pre-wet roller 6. In this way, the developing liquid past the development area is re-used instead of being disposed of as a waste. Thus, recycling of the developing liquid in the image forming apparatus is established.

As described above, according to the second embodiment, the toner density of the developing liquid past the development area is controlled by the density regulating apparatus 50 to have a predetermined density level before being returned to the developing tank 21. With this construction, the amount of developing liquid supplemented to the developing liquid tank 21 is significantly reduced. Accordingly, it is ensured that a far longer period of time elapses before an overflow of the developing liquid from the developing liquid tank 21 occurs. Further, by regulating the density appropriately, it is possible to prevent an overflow from occurring.

Figure 11:
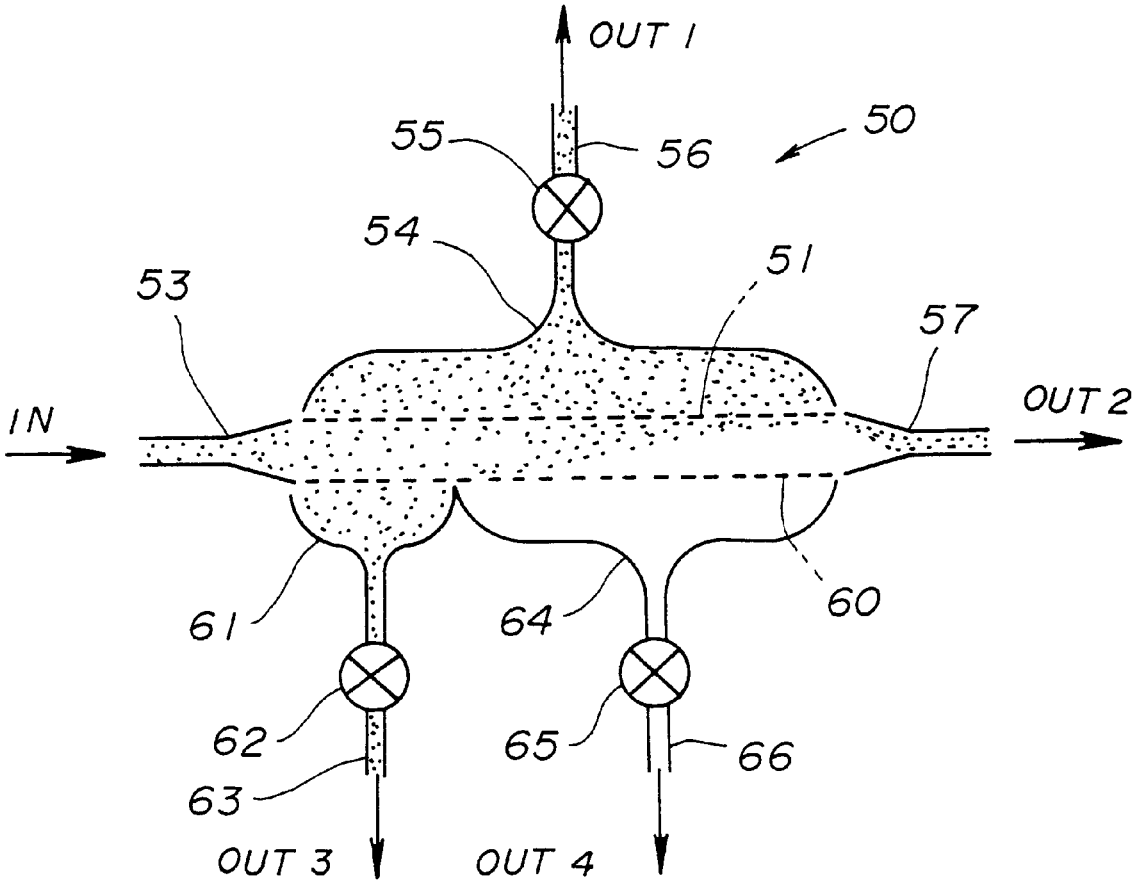
FIG. 11 shows a schematic construction of a density regulating apparatus according to a variation of the second embodiment.

FIG. 11 shows a schematic construction of the density regulating apparatus 50 according to a variation of -the second embodiment. The density regulating apparatus 50 according to the variation is provided with a second mesh electrode 60 (hereinafter, the mesh electrode 51 will be referred to as the first mesh electrode) in place of the plate electrode 52 in the density regulating apparatus 50 shown in FIG. 9. The second mesh electrode 60 is provided with minute openings through which the developing liquid can pass. In the following description, it is assumed that the toner particles are positively charged and the potential of the first mesh electrode 51 is controlled to be lower than the potential of the second mesh electrode 60.

As shown in FIG. 11, the developing liquid collected via the second mesh electrode 60 contains a certain amount of toner particles in the upstream side of the flow of the developing liquid, but contains hardly any toner particles in the upstream side. The bottom of the density regulating apparatus 50 opposite to the back of the second mesh electrode not facing the first mesh electrode 51 is divided into two sections, namely an upstream chamber 61 and a downstream chamber 64. In the upstream chamber 61, a negative pressure with respect to the pressure occurring between the electrodes 51 and 60 is generated by a pump 62. In the downstream chamber 64, a negative pressure is generated by a pump 65. In this way, low-density developing liquid is collected via the upstream chamber 61, the pump 62 and a third developing liquid collecting passage 63. Pure carrier liquid is collected via the downstream chamber 64, the pump 65 and a fourth developing liquid collecting passage 66.

The conditions including the size of the openings in the first and second mesh electrodes 51 and 60, the surface area of the electrodes 51 and 52, the speed of the flow of the developing liquid supplied to the gap between the electrodes, the voltage applied to the electrodes are controlled so that the developing liquid of a predetermined density is collected via the first developing liquid collecting passage 56 and the pure carrier liquid is collected via the fourth developing liquid collecting passage 66. The developing liquid of a predetermined density collected via the first developing liquid collecting passage 56 is returned to the developing liquid tank 21. The low-density developing liquid collected via the second developing liquid collecting passage 57 and the third developing liquid collecting passage 63 are returned to the carrier liquid tank 28. The carrier liquid collected via the fourth developing liquid collecting passage 66 is returned to the pre-wet liquid container 6*a* adjacent to the pre-wet roller 6. In this way, the developing liquid past the development area is re-used instead of being disposed of as a waste. Thus, recycling of the developing liquid in the image forming apparatus is established. It is also to be appreciated that the filter need not be provided according to the variation.

Figure 2:
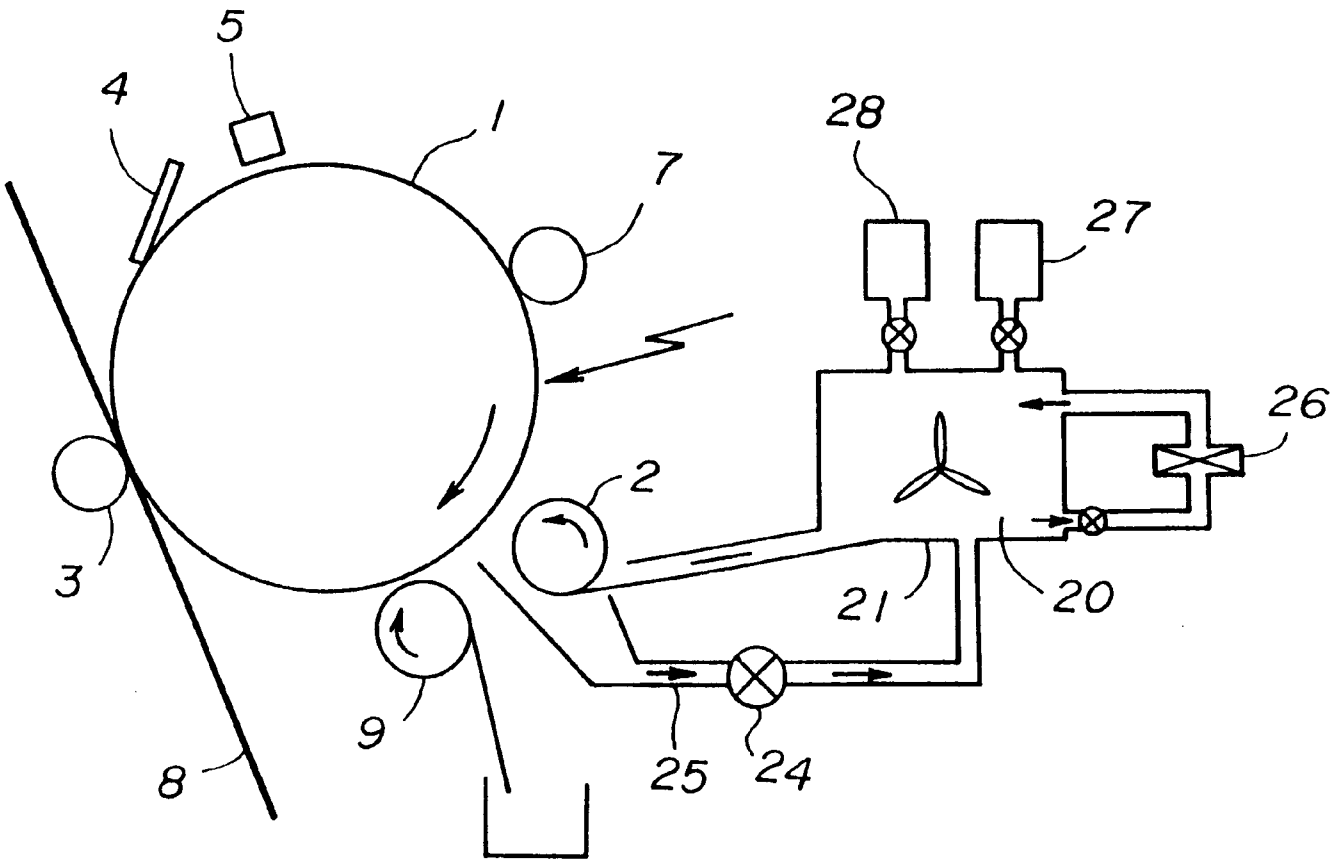
FIG. 2 PRIOR ART
FIG. 2 is a front view showing a schematic construction of an image forming apparatus in which a low-density developing liquid is used.

In the above description of the first and second embodiments, it is assumed that the density regulating apparatus is used in an image forming apparatus using high-density developing liquid as means to restore the toner density of the developing liquid past the development area. However, the density regulating apparatus according to the first and second embodiments may also be applied to an image forming apparatus as shown in FIG. 2 using low-density developing liquid.

A description will now be given of a density regulating apparatus and an image forming apparatus according to a third embodiment of the present invention.

The image forming apparatus according to the third embodiment is provided with: a high-density developing liquid tank for containing developing liquid having a higher solid content density than a prescribed solid content density required of the developing liquid in the developing liquid tank; a prescribed-density developing liquid tank for containing developing liquid having a solid content density closer to a prescribed solid content density than the developing liquid contained in the high-density developing liquid tank, or having a solid content density equal to the prescribed solid content density; and liquid supplying devices for independently supplying liquid from each of the high-density developing liquid tank and the prescribed-density developing liquid tank to the developing liquid tank.

Figure 12:
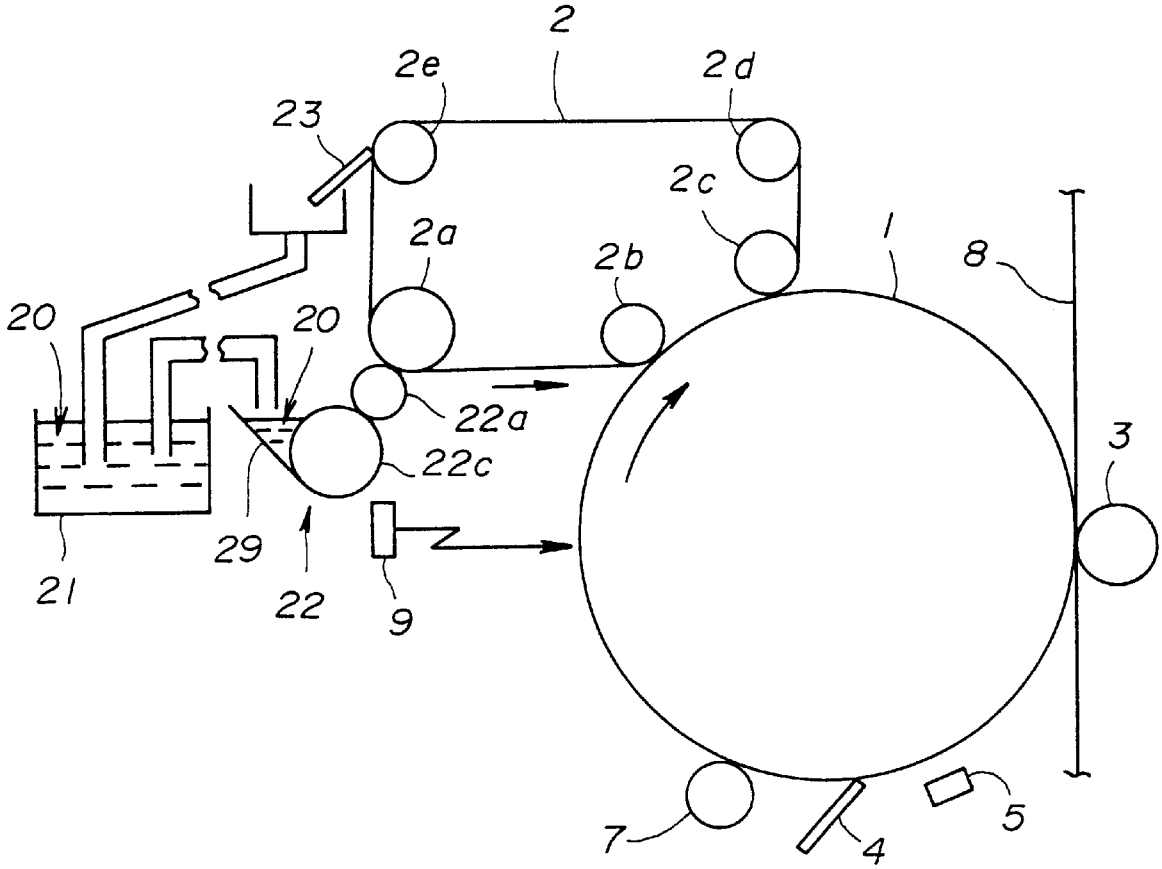
FIG. 12 shows a schematic construction of an image forming apparatus according to a third embodiment.

FIG. 12 shows a schematic construction of an image forming apparatus according to the third embodiment. The construction of the image forming apparatus of FIG. 12 is similar to the construction as shown in FIG. 1, so that the description of like elements designated by like numerals is omitted. The image forming apparatus differs from the image forming apparatus of FIG. 1 in that the developing liquid is supplied from the developing liquid tank 21 from a developing liquid reservoir formed by causing a blade 29 to contact an application roller 22*c* at the upstream extreme end. Numeral 9 in FIG. 12 indicates an optical write apparatus.

Figure 13:
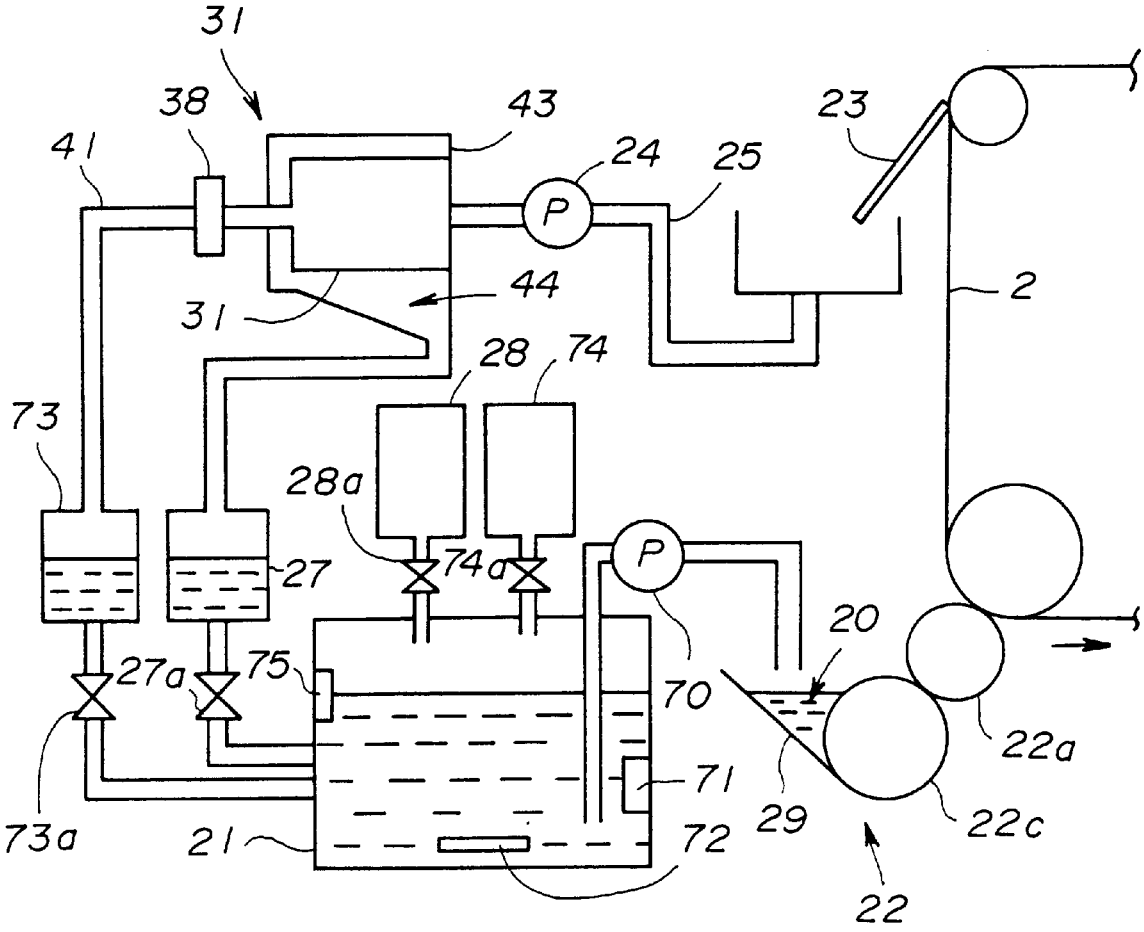
FIG. 13 shows a detailed construction of the image forming apparatus according to the third embodiment.

FIG. 13 shows a detailed construction of the image forming apparatus according to the third embodiment.

As shown in FIG. 13, the image forming apparatus according to the third embodiment includes a low-density developing liquid tank 73 and a prescribed-density developing liquid tank 74, in addition to the high-density developing liquid tank 27 and the carrier liquid tank 28. The four tanks independently supply respective liquid to the developing liquid tank 21. More specifically, supply control parts 27*a*, 28*a*, 73*a* and 74*a* each embodied by, for example, an electromagnetic valve are provided in respective passages communicating with the developing liquid tank 21. Each of the supply control parts 27*a*, 28*a*, 73*a* and 74*a* may be controlled to supply or not to supply respective liquid to the developing liquid tank 21. The prescribed-density developing liquid tank 74 contains developing liquid controlled to have a desired developing liquid density of the developing liquid tank 21 (hereinafter, such developing liquid will be referred to as prescribed-density developing liquid). The low-density developing liquid tank 73 contains developing liquid having a lower density than the prescribed-density developing liquid.

The image forming apparatus according to the third embodiment is provided with the developing liquid density regulating apparatus 30 shown in FIG. 4. The first developing liquid drain passage 41 of the developing liquid density regulating apparatus 30 is connected to the low-density developing liquid tank 73, and the second developing liquid drain passage 44 is connected to the carrier liquid tank 28. The inner diameter and the revolution of the developing liquid density regulating apparatus 30, the material forming the sleeve 32, and the size of the openings provided in the sleeve 32 are controlled so that the developing liquid collected via the developing liquid drain passages 41 and 44 has a desired density.

The developing liquid tank 21 of the image forming apparatus according to the third embodiment is also provided with a viscosity meter 71 for measuring the viscosity of the developing liquid, a churning device 72 for churning the developing liquid, a liquid surface sensor 75 for measuring a height of the surface of the developing liquid. Numeral 70 indicates a pump for drawing the developing liquid from the developing liquid tank 21 and supplying the drawn developing liquid to the application roller 22*c* at the upstream extreme.

Figure 14:
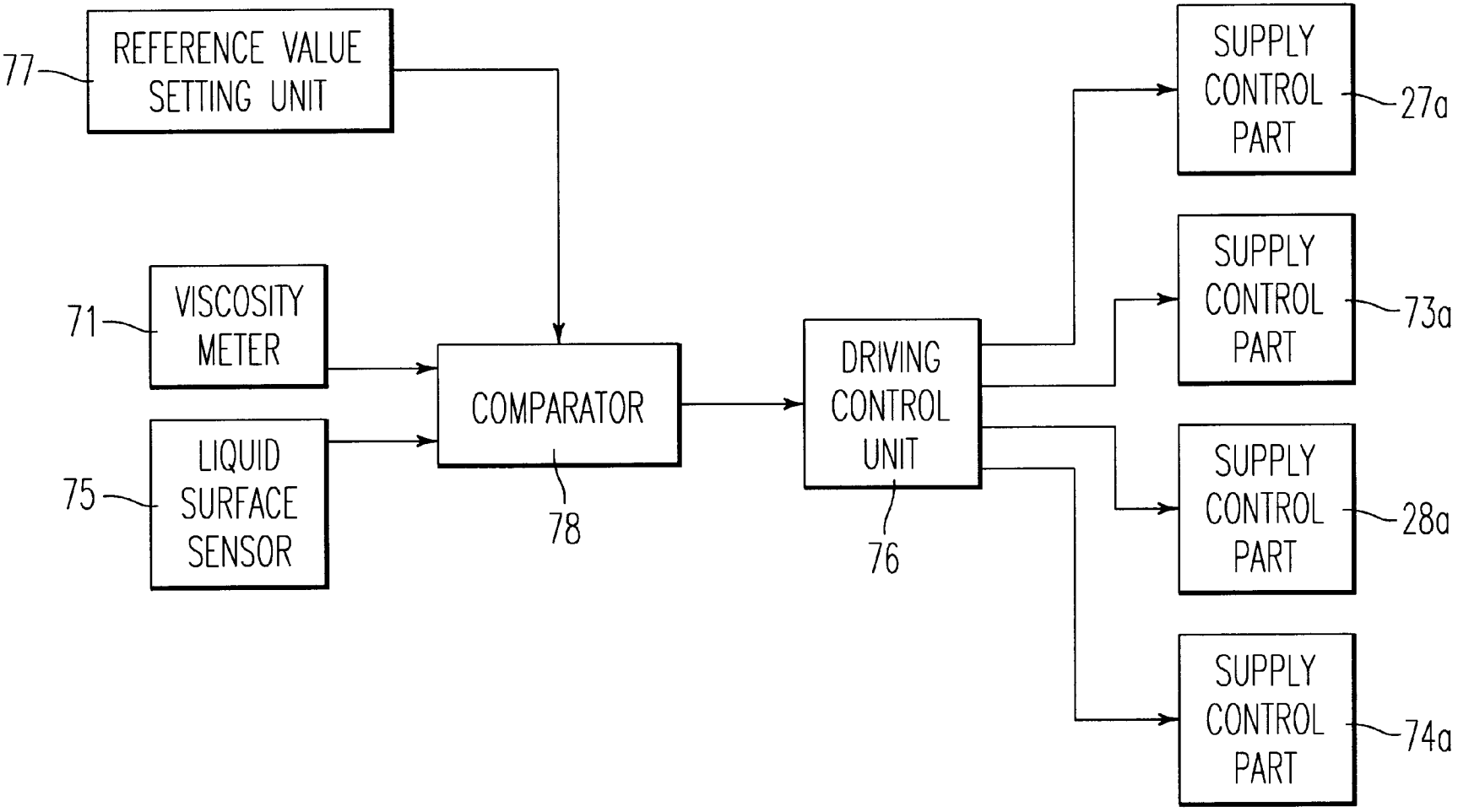
FIG. 14 is a block diagram showing an electric unit for controlling a process using a viscosity meter and a liquid surface sensor.

FIG. 14 is a block diagram showing an electric unit for controlling a process using the viscosity meter 71 and the liquid surface sensor 75. The output from the viscosity meter 71 and the liquid surface sensor 75 is fed to a comparator 78. The comparator 78 compares the outputs with a tolerable viscosity range, a desired liquid surface level and a reference value related to the speed at which the liquid surface lowers. The tolerable viscosity range, the desired liquid surface level and the reference value related to the liquid surface lowering speed are stored in a reference value setting unit 77. The comparator 78 outputs a result of comparison to a driving control unit 76. The driving control unit 76 controls the supply control parts 27*a*, 28*a*, 73*a* and 74*a*.

Figure 15A:
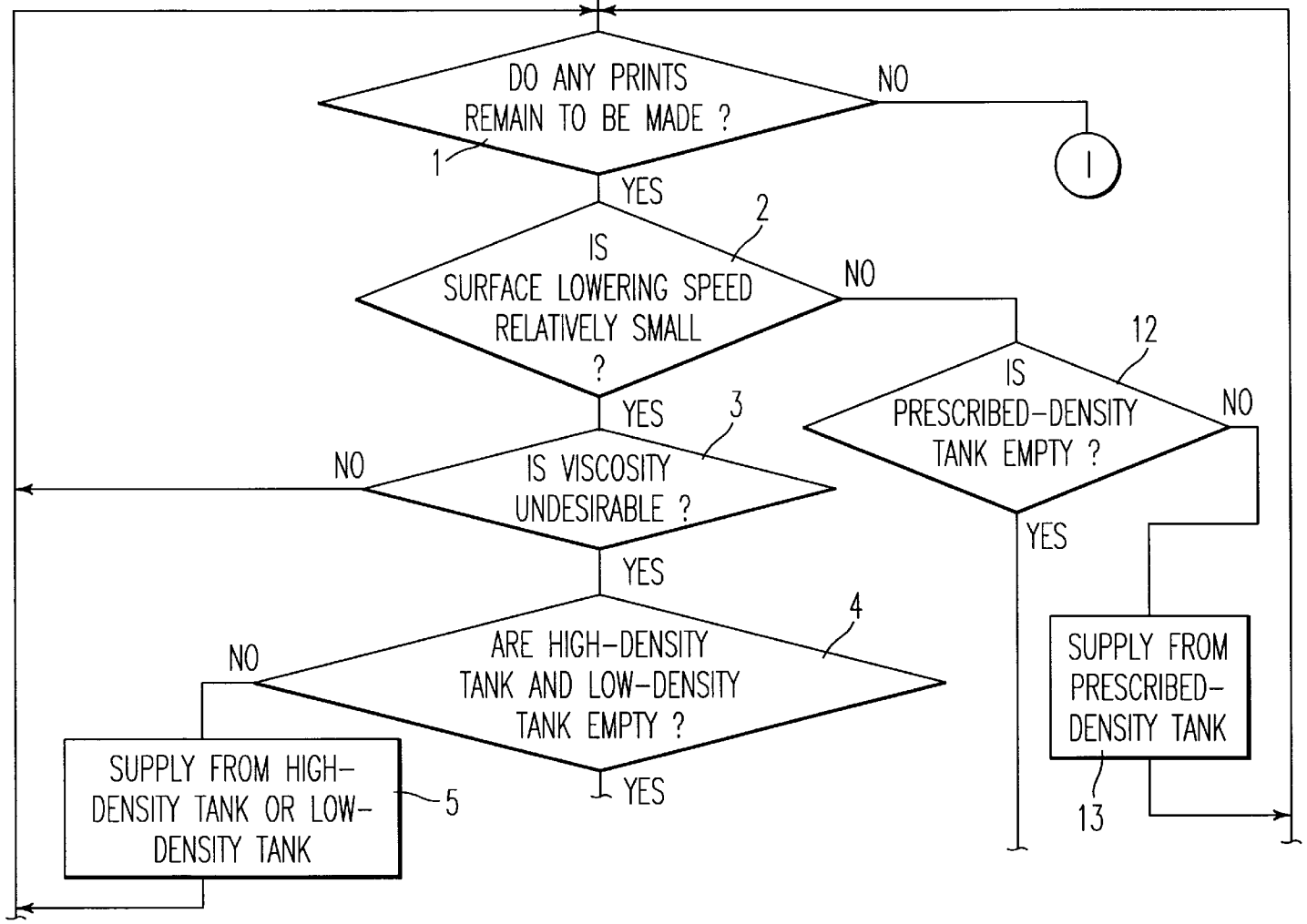
FIGS. 15 and 16 are flowcharts showing the control effected by the electric unit.
Figure 15B:
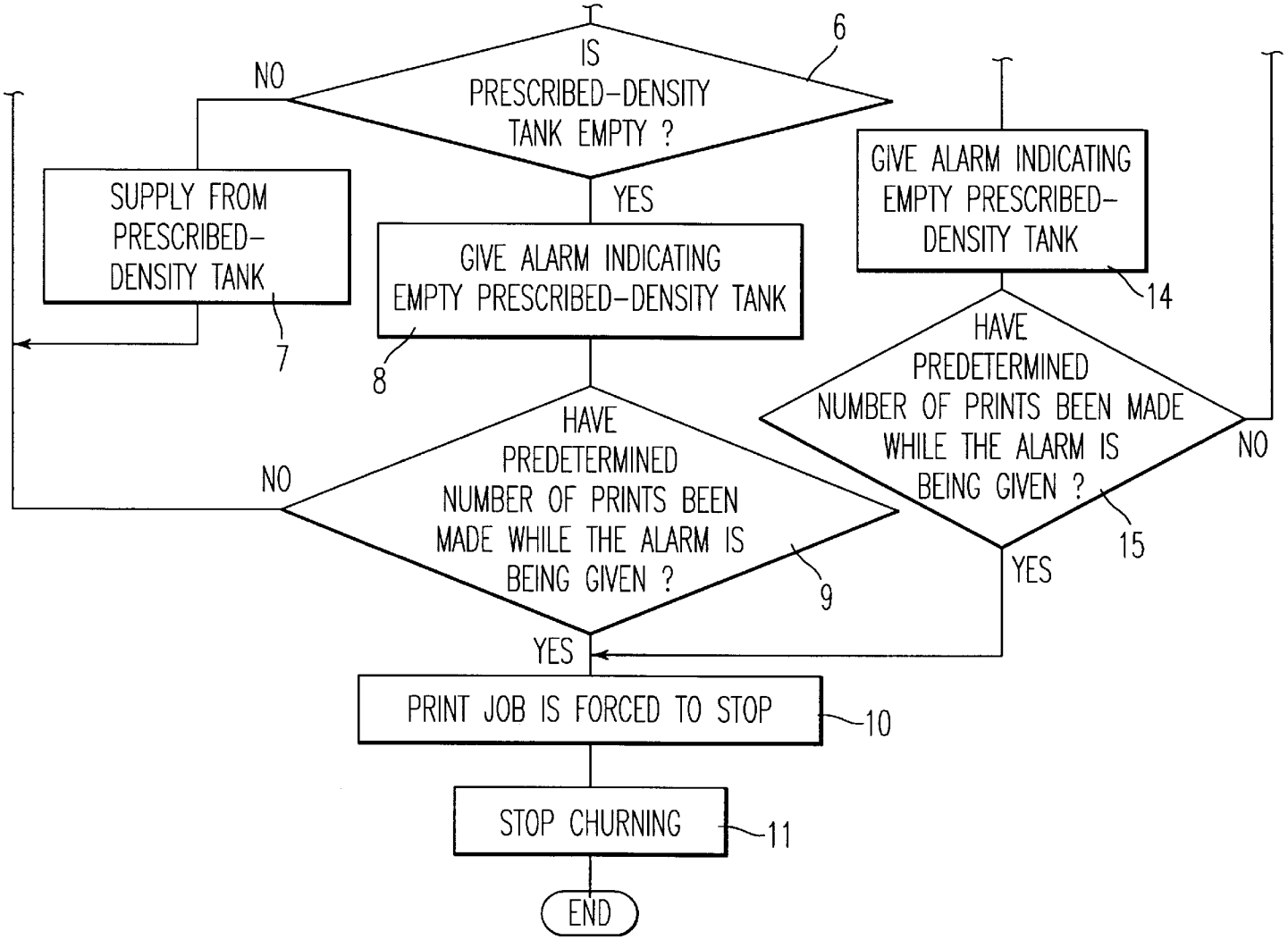
Figure 16:
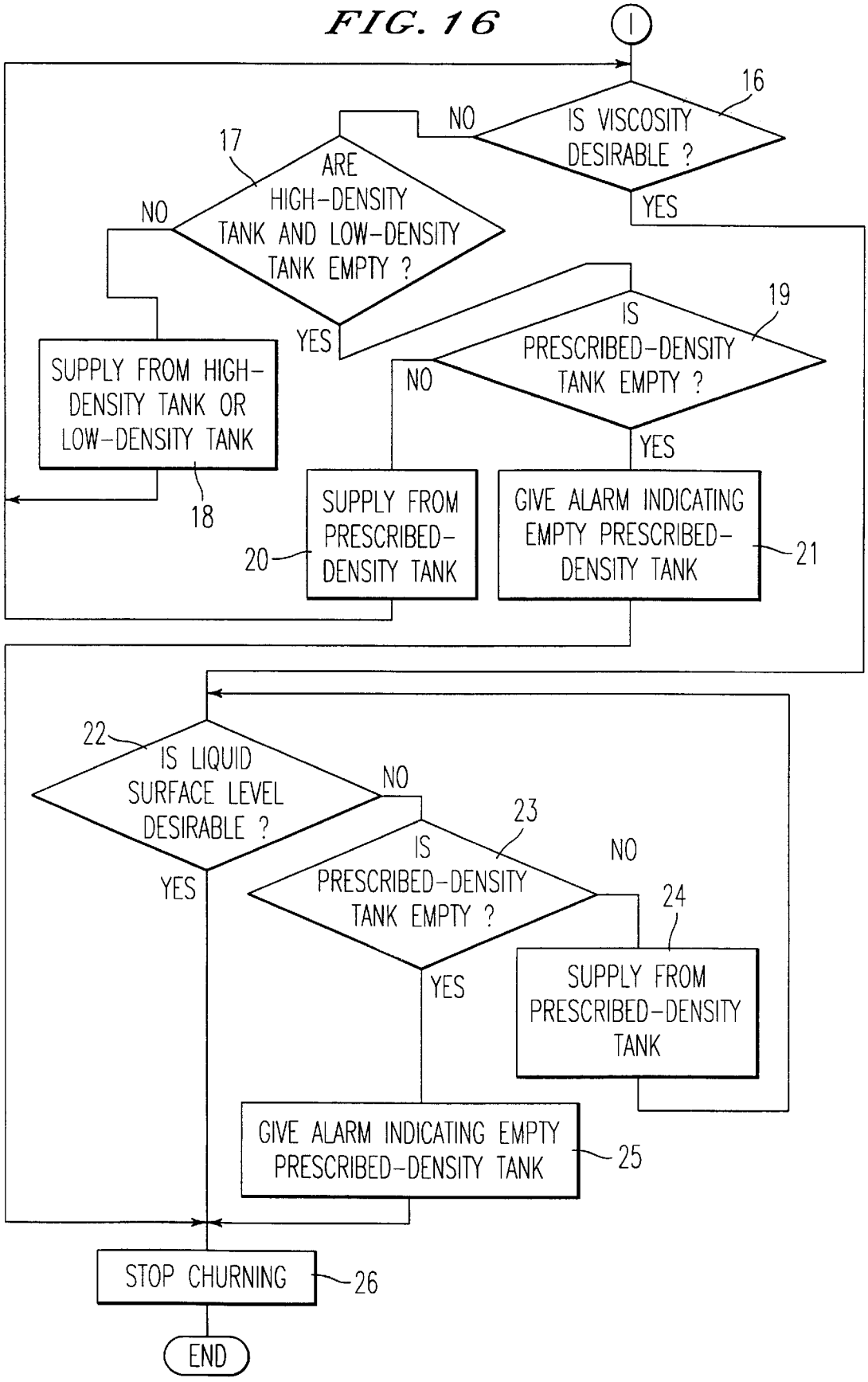

FIGS. 15 and 16 are flowcharts showing the control effected by the electric unit as described above. The control shown in the flowcharts is executed every time a printing job is started. A determination is made as to whether a printing job is proceeding by determining whether any prints remain to be made (step 1). When it is determined that a printing job is proceeding, the liquid surface sensor 75 is used so as to determine whether the speed at which the surface of the liquid is being lowered is lower than a predetermined speed. If the measured speed is lower than the predetermined speed, the output from the viscosity meter 71 is referred to (step 3). If it is found in step 3 that the viscosity is not at a desired level, a first viscosity regulating mode is executed wherein the high-density developing liquid tank 27 and the low-density developing liquid tank 73 are selectively used. If it is determined in step 2 that the measured speed is higher than the predetermined speed, a second viscosity regulating mode wherein the prescribed-density developing liquid tank 74 is used is executed (steps 12 and 13).

More specifically, in the first viscosity regulating mode, a determination is made as to whether both of the high-density developing liquid tank 27 and the low-density developing liquid tank 73 are empty (step 4) If a negative answer is yielded in step 4, one of the tanks which is not empty is used to supply respective liquid to the developing liquid tank 21 (step 5), whereupon the control is returned to step 1. If an affirmative answer is yielded in step 4, a determination is made as to whether the prescribed-density developing liquid tank 74 is empty (step 6). If it is determined that the prescribed-density developing tank 74 is not empty, the prescribed-density developing tank 74 is used to supply the developing liquid to the developing liquid tank 21 (step 7), whereupon the control is returned to step 1. If it is determined that the prescribed-density developing liquid tank 74 is empty, an alarm is given accordingly (step 8) (for example, an alarm is displayed in an operation panel or the like), whereupon the control is returned to step 1.

In the second viscosity regulating mode, a determination is made as to whether the prescribed-density developing liquid tank 74 is empty (step 12). If it is determined that the prescribed-density developing tank 74 is not empty, the prescribed-density developing tank 74 is used to supply the developing liquid to the developing liquid tank 21 (step 13), whereupon the control is returned to step 1. If it is determined that the prescribed-density developing liquid tank 74 is empty, an alarm is given accordingly (step 14) (for example, an alarm is displayed in an operation panel or the like), whereupon the control is returned to step 1.

One of the two modes described above is repeated for each of the prints. In the process of repeating, when it is determined that a predetermined number of prints (for example, twenty prints) have been made while the alarm is being given, the print job is forced to stop and the churning device 72 is stopped (that is, if an affirmative answer is yielded in step 9 or step 15, the control is turned to step 10 or step 11, respectively). If it is determined that the print jobs have been completed, that is, if a negative answer is yielded in step 1, the control is turned to step 16 (FIG. 16) where a determination is made as to whether the output of the viscosity meter 71 indicates that the viscosity is at a desirable level. Step 16 and subsequent steps are directed to control performed after the print jobs are completed.

Steps 17–21 are performed to control the viscosity.

In the viscosity control, a determination is made as to whether both of the high-density developing liquid tank 27 and the low-density developing liquid tank 73 are empty (step 17) If a negative answer is yielded in step 17, one of the tanks which is not empty is used to supply respective liquid to the developing liquid tank 21 (step 18), whereupon the control is returned to step 16. If an affirmative answer is yielded in step 17, a determination is made as to whether the prescribed-density developing liquid tank 74 is empty (step 19). If it is determined that the prescribed-density developing tank 74 is not empty, the prescribed-density developing tank 74 is used to supply the developing liquid to the developing liquid tank 21 (step 20), whereupon the control is returned to step 16. If it is determined that the prescribed-density developing liquid tank 74 is empty, an alarm is given accordingly (step 21) (for example, an alarm is displayed in an operation panel or the like), whereupon the churning device 72 is stopped so that the viscosity control is terminated.

Steps 22–25 are performed to control the level of the liquid surface.

In the liquid surface level control, a determination is made as to whether the output of the liquid surface sensor 75 indicates that the liquid surface is at a desired level (step 22). If the level of the liquid surface is not desirable, a determination is made as to whether the prescribed-density developing liquid tank 74 is empty (step 23). If it is determined that the prescribed-density developing tank 74 is not empty, the prescribed-density developing tank 74 is used to supply the developing liquid to the developing liquid tank 21 (step 24), whereupon the control is returned to step 22. If it is determined that the prescribed-density developing liquid tank 74 is empty, an alarm is given accordingly (step 25) (for example, an alarm is displayed in an operation panel or the like), whereupon the churning device 72 is stopped so that the liquid surface level control is terminated.

If it is determined that both the viscosity and the liquid surface level are desirable (Yes in step 22), the churning device 72 is stopped and the control is terminated.

As described above, in the image forming apparatus of the third embodiment, one of the two modes for regulating the viscosity is used depending on the speed at which the surface of the developing liquid lower. In the first viscosity regulating mode, the high-density developing liquid tank 27 and the low-density developing liquid tank 73 are mainly used. In the second viscosity regulating mode, the prescribed-density developing liquid tank is used.

When the speed at which the surface of the developing liquid lowers is high, the prescribed-density developing liquid tank may preferably be used to prevent the quality of the image being printed from being degraded, because the effect of the prescribed density-developing liquid tank is immediately available. Thus, the second viscosity regulating mode is particularly useful in an apparatus in which the performance of the churning device 72 is poor in relation the capacity of the developing liquid tank 21. When the performance of the churning device 72 is sufficient in relation to the capacity of the developing liquid tank 21, the image forming apparatus may be provided only the first mode.

Since the prescribed-density developing liquid tank 74 is used in the liquid surface level control performed after the viscosity control, an error in the viscosity is prevented from occurring by using the developing liquid having a density different from the prescribed density in order to control the liquid surface level.

Figure 17:
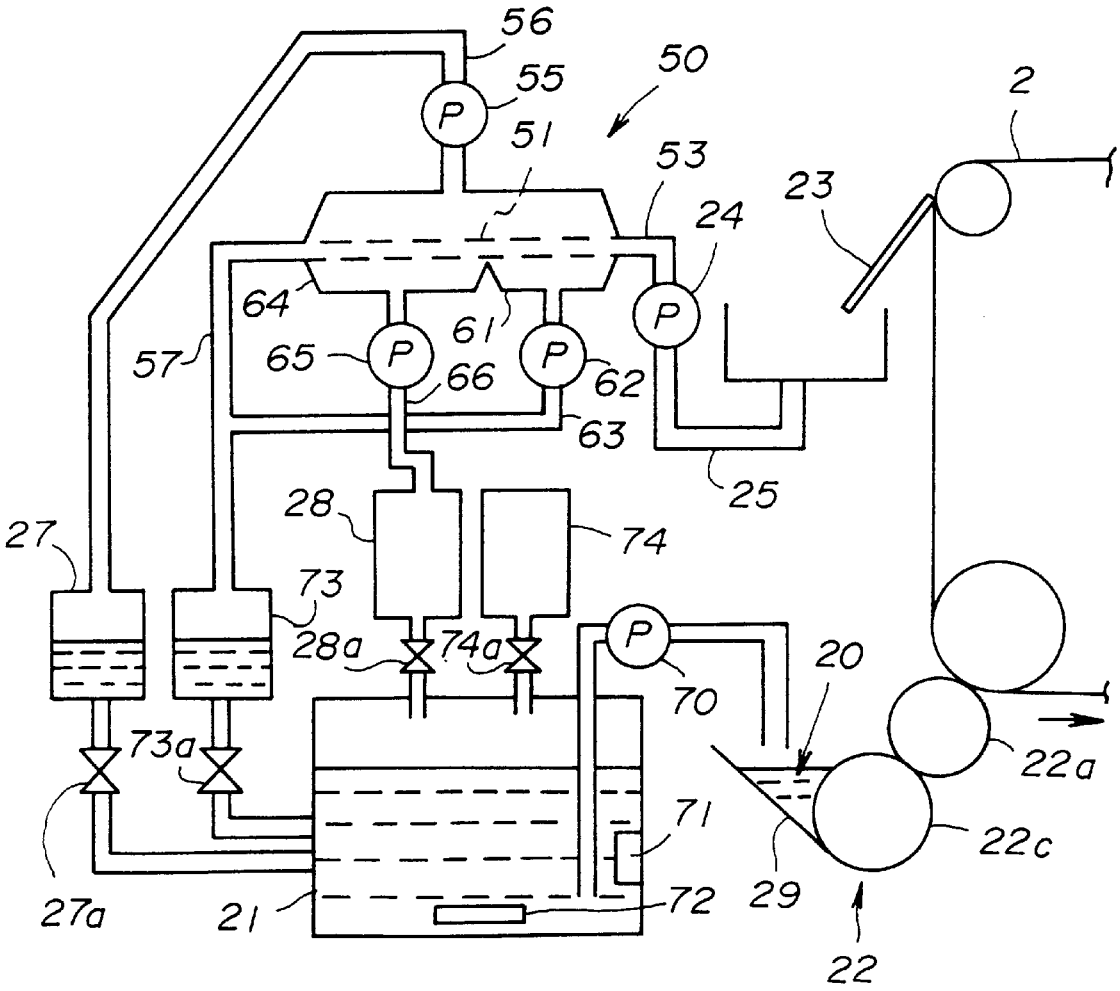
FIG. 17 shows a construction of an image forming apparatus according to a variation of the third embodiment.

FIG. 17 shows a construction of the image forming apparatus according to a variation of the third embodiment. In the image forming apparatus of FIG. 17, the developing liquid density regulating apparatus 50 of FIG. 11 is used instead of the developing liquid regulating apparatus 30 of FIG. 4. The developing liquid collected by the developing liquid density regulating apparatus 50 is supplied to respective tanks coupled to the developing liquid tank 21. In this example, the first developing liquid collecting passage 56, collecting the developing liquid higher in density than that collected via the passages 57, 63 and 66, is connected to the high-density developing liquid tank 27. The fourth developing liquid collecting passage 66, collecting the developing liquid lower in density (to an extent that only the carrier liquid is substantially collected depending on the apparatus) than that collected via the passages 56, 57 and 63, is connected to the carrier liquid tank 28. The developing liquid collecting passages 57 and 63 are joined together to be connected to the low-density developing liquid tank 73.

The control as shown in FIGS. 15 and 16 may be applied to the image forming apparatus of FIG. 17.

A description will now be given of an image forming apparatus and a developing liquid density regulating apparatus according to a fourth embodiment of the present invention.

Figure 18:
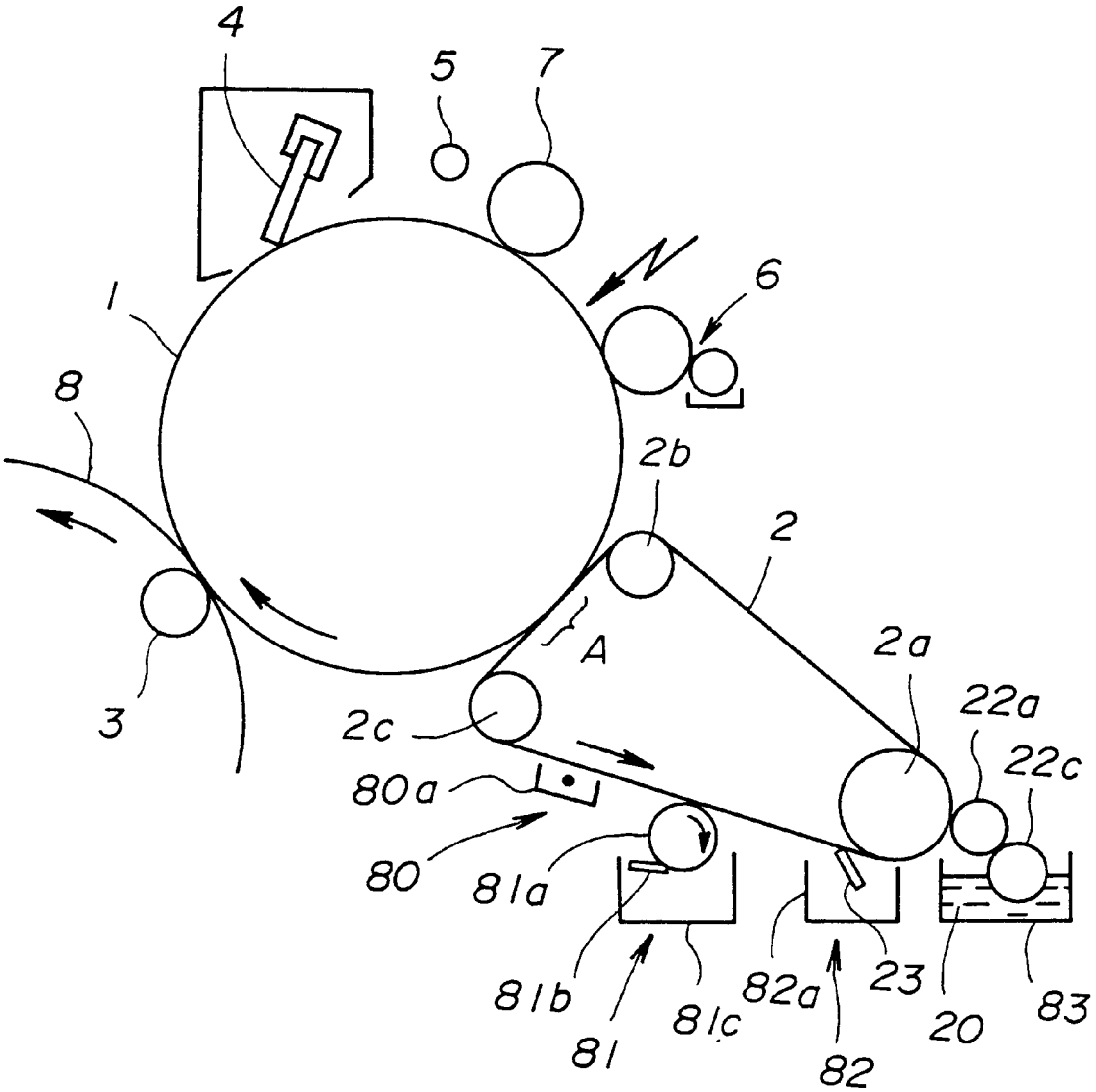
FIG. 18 shows a schematic construction of an image forming apparatus according to a fourth embodiment.

FIG. 18 shows a schematic construction of the image forming apparatus according to the fourth embodiment.

The image forming apparatus according to the fourth embodiment comprises the charging roller 7 provided alongside the photosensitive drum 1, the pre-wet roller 6 for applying a pre-wet liquid to the photosensitive drum 1, the developing belt 2, the transfer roller 3, the cleaning blade 4, and the discharging lamp 5. An optical write unit illuminates the photosensitive drum 1 charged by the charging roller 7 so as to form an electrostatic latent image. A chemically inactive dielectric liquid such as dimethyl-polysiloxane oil is uniformly and releasably applied by the pre-wet roller 6 to the surface of the photosensitive drum 1 on which the electrostatic latent image is formed. The developing belt 2 is used to apply the developing liquid to the electrostatic latent image on the photosensitive drum 1 so as to produce a visible image. Dimethyl-polysiloxane oil (the same substance as used to provide the pre-wet liquid) may be used to provide a solvent for the developing liquid. Alternatively, an insulating liquid having a characteristic different from that of the pre-wet liquid may be used. The developing liquid is formed such that the toner is dispersed in the solvent with a high density and, as a result, has a relatively high viscosity.

The visible image formed on the photosensitive drum 1 is transferred by the transfer roller 3 to the paper 8 and then fixed by a fixing unit (not shown) by heat and pressure. The charge that remain on the photosensitive drum 1 is removed by the discharging lamp 5, whereupon the above-described process is repeated.

The image forming apparatus according to the fourth embodiment is also provided with a particle aggregating unit 80, a liquid removal unit 81 and a toner collecting unit 82. The developing belt 2 is formed of an endless belt wound around a driving roller 2*c*, and driven rollers 2*a* and 2*b*. A bias applying unit (not shown) applies a potential having a level between a minimum potential and a maximum potential of the electrostatic latent image on the photosensitive drum 1, to the developing belt 2. The image forming apparatus of FIG. 18 is also provided with a developing liquid container 83 for containing the developing liquid 20, and the developing liquid applying rollers 22*a* and 22*c*. The developing liquid applying rollers 22*a* and 22*c* apply the developing liquid 20 in the developing liquid container 83 to the surface of the developing belt 2 so as to form a thin layer of the developing liquid thereon. A corona charger 80*a* constituting the particle aggregating unit 80 is provided adjacent to the surface of the developing belt 2 at a location which is downstream of a development area between where the developing belt 2 contacts the photosensitive drum 1 and a developing process occurs, and which is upstream of the liquid removal unit 81. The corona charger 80*a* irradiates the toner in a liquid layer that remains on the developing belt past the development area with positive (that is, having the same polarity as the toner) ions, the liquid layer containing the pre-wet liquid and the developing liquid solvent. In this way, the toner is attracted toward the surface of the developing belt 2, thus forming a toner aggregate layer separate from the liquid layer. The liquid removal unit 81 is provided downstream of the development area and upstream of the developing liquid applying rollers 22*a* and 22*c* so as to remove the pre-wet liquid and the developing liquid solvent that remain on the developing belt 2 past the development area. The liquid removal unit 81 consists of a liquid collecting roller 81*a*, a wiping blade 81*b*, and a liquid collecting tank 81*c*. The liquid collecting roller 81*a* slightly touches the surface of the developing belt 2 and is rotated in the same direction as the developing belt 2. The liquid collecting roller 81*a* may be embodied by a roller formed of a conductive porous material such as a foamed urethane having conductive particles such as carbon black mixed therein. Alternatively, the liquid collecting roller 81*a* may be embodied by a metal roller having a resistance layer on the surface thereof. A positive (that is, having the same polarity as the toner) bias potential is applied to the liquid collecting roller 81*a*. The toner collecting unit 82 collects the toner that remain on the developing belt 2 past the developing area.

The electrostatic latent image formed on the photosensitive drum 1 is made visible in the following process. The developing liquid 20 in the developing liquid container 83 is applied by the developing liquid applying rollers 22*a* and 22*c* to the surface of the developing belt 2 so as to form a thin layer of the developing liquid 20. The developing belt 2 carrying the developing liquid layer touches the photosensitive drum 1. As the developing belt 2 is rotated in the same direction and at the same speed as the photosensitive drum 1, the electrostatic latent image formed on the photosensitive drum 1 is made visible. Since the developing belt 2 causes the thin layer of the developing liquid 20 to contact the pre-wet liquid layer on the photosensitive drum 1, it is ensured that a distributed uniform contact pressure occurs in the thin layer of the developing liquid 20. Thus, the thin layer of the developing liquid 20 is prevented from being collapsed locally so that the image is prevented from disturbed.

Downstream of the development area where the developing belt 2 contacts the photosensitive drum 1, the pre-wet liquid layer is transferred to the developing belt 2 so as to reside on the developing liquid layer that contains the toner for non-image portions. Thus, the liquid layer consisting of the pre-wet liquid and the developing liquid solvent, the residual toner layer, and the dispersion layer in which the toner is dispersed in the pre-wet liquid and the developing liquid solvent are formed on the developing belt 2 past the development area. The corona charger 80*a* irradiates the toner in the residual toner layer and the dispersion layer on the developing belt past the development area with positive ions. The toner irradiated with the positive ions is electrostatically attracted toward the surface of the developing belt 2 so as to form a toner aggregate layer separate from the liquid layer. When the developing belt 2 having the liquid layer and the toner aggregate layer passes through the liquid removal unit 81, the pre-wet liquid and the developing liquid solvent are removed and collected. Since the liquid layer formed by the pre-wet liquid and the developing liquid solvent is separate from the toner aggregate layer, it is ensured that only the liquid collecting roller 81*a* of the liquid removal unit 81 collects only the liquid layer. Accordingly, the toner is prevented from mixing in the liquid collected in the liquid collecting tank 81*c* so that the collected liquid is readily subject to a post-development process for re-use.

Portions of the liquid layer and the toner aggregate layer that remains on the developing belt 2 past the liquid removal unit 81 are collected by the toner collecting unit 82. Thus, the pre-wet liquid is prevented from mixing in the developing liquid 20 in the developing liquid container 83 so that the developing liquid 20 exhibits a constant performance in producing visible images for a relatively long period of time in which it is used. Thus, the image forming apparatus produces quality images in a stable manner.

While it is assumed in the description above that the particle aggregating unit 80 is embodied by the corona charger 80*a* provided adjacent to the developing belt 2, the particle aggregating unit 80 may alternatively embodied by a charger roller provided at some distance from the surface of the developing belt 2. In this case, the performance of the charging roller for charging the residual toner on the developing belt 2 drops if the pre-wet liquid and the like is attached to the surface of the charging roller. This drop in the charging performance is avoided by providing a cleaning blade on the surface of the charging roller for continuously cleaning the surface of the charging roller so that the residual toner on the developing belt is aggregated in a stable manner.

The particle aggregating unit 80 according to the fourth embodiment may also be used in an image forming apparatus in which the pre-wet liquid is not applied to the photosensitive drum 1.

As shown in FIG. 18, by using the particle aggregating unit 80 in combination with the liquid removal unit 81 and the toner collecting unit 82, the liquid is collected at a desired location.

Figure 19:
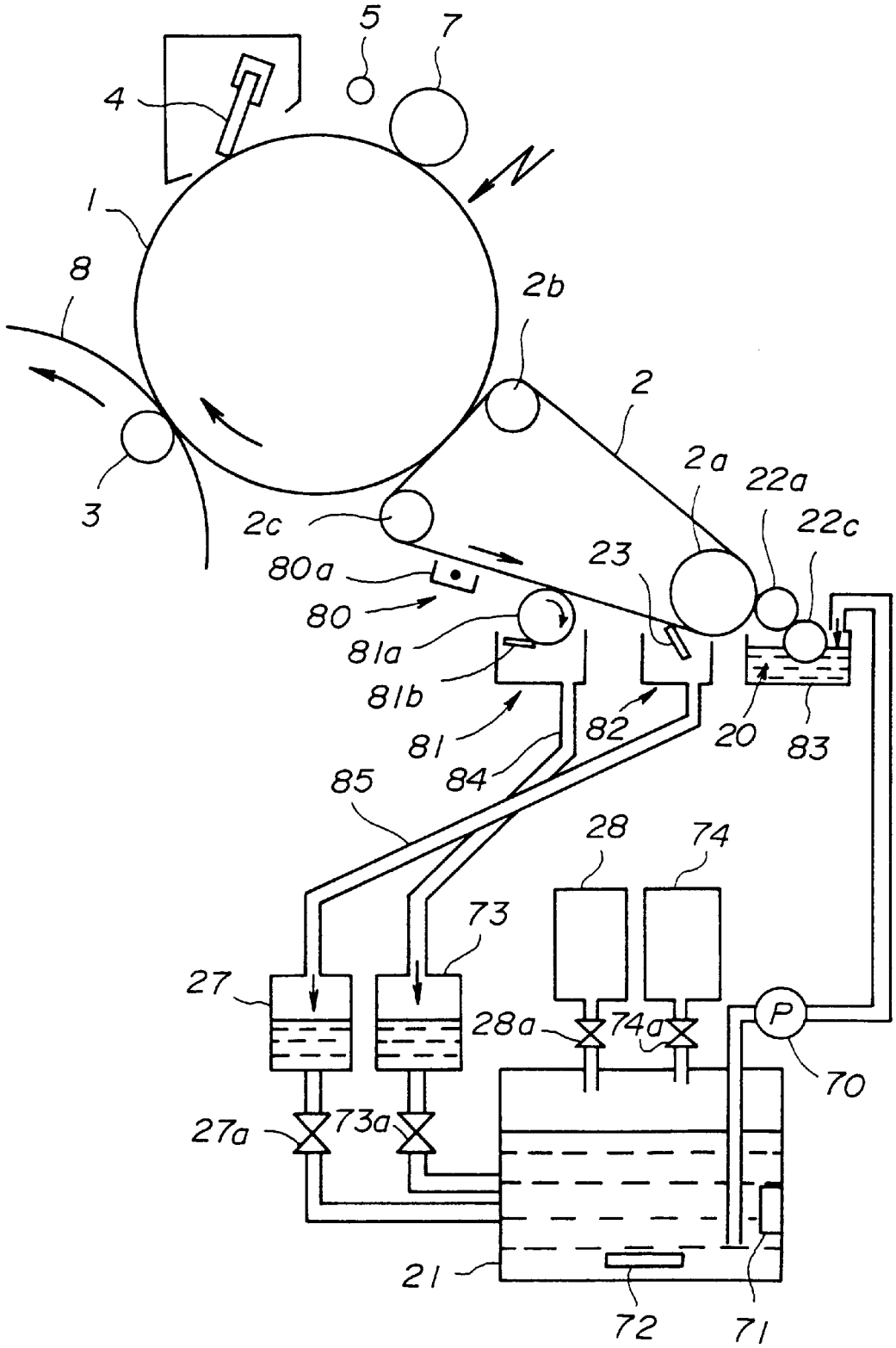
FIG. 19 shows a schematic construction of an image forming apparatus in which pre-wet liquid is not used and to which a particle aggregating unit, a liquid removal unit and a toner collecting unit are applied.

FIG. 19 shows a schematic construction of an image forming apparatus in which pre-wet liquid is not used and to which the particle aggregating unit 80, the liquid removal unit 81 and the toner collecting unit 82 are applied. The liquid collected by the liquid removal unit 81, substantially devoid of the toner and mainly contains carrier liquid, is supplied to the carrier liquid tank 28. The liquid collected by the toner collecting unit 82, high in the toner density, is supplied to the high-density developing liquid tank 27. The high-density developing liquid tank 27, the carrier liquid tank 28, the low-density developing liquid tank 73 and the prescribed-density developing liquid tank 74 are coupled to the developing liquid tank 21. Each of the supply control parts 27*a*, 28*a*, 73*a* and 74*a* may be controlled to supply or not to independently supply respective liquid to the developing liquid tank 21. The viscosity control and the liquid surface level control using the supply from the four tanks to the developing liquid tank 21 may be effected in accordance with the control described with reference to FIGS. 12 through 16.

Figure 20:
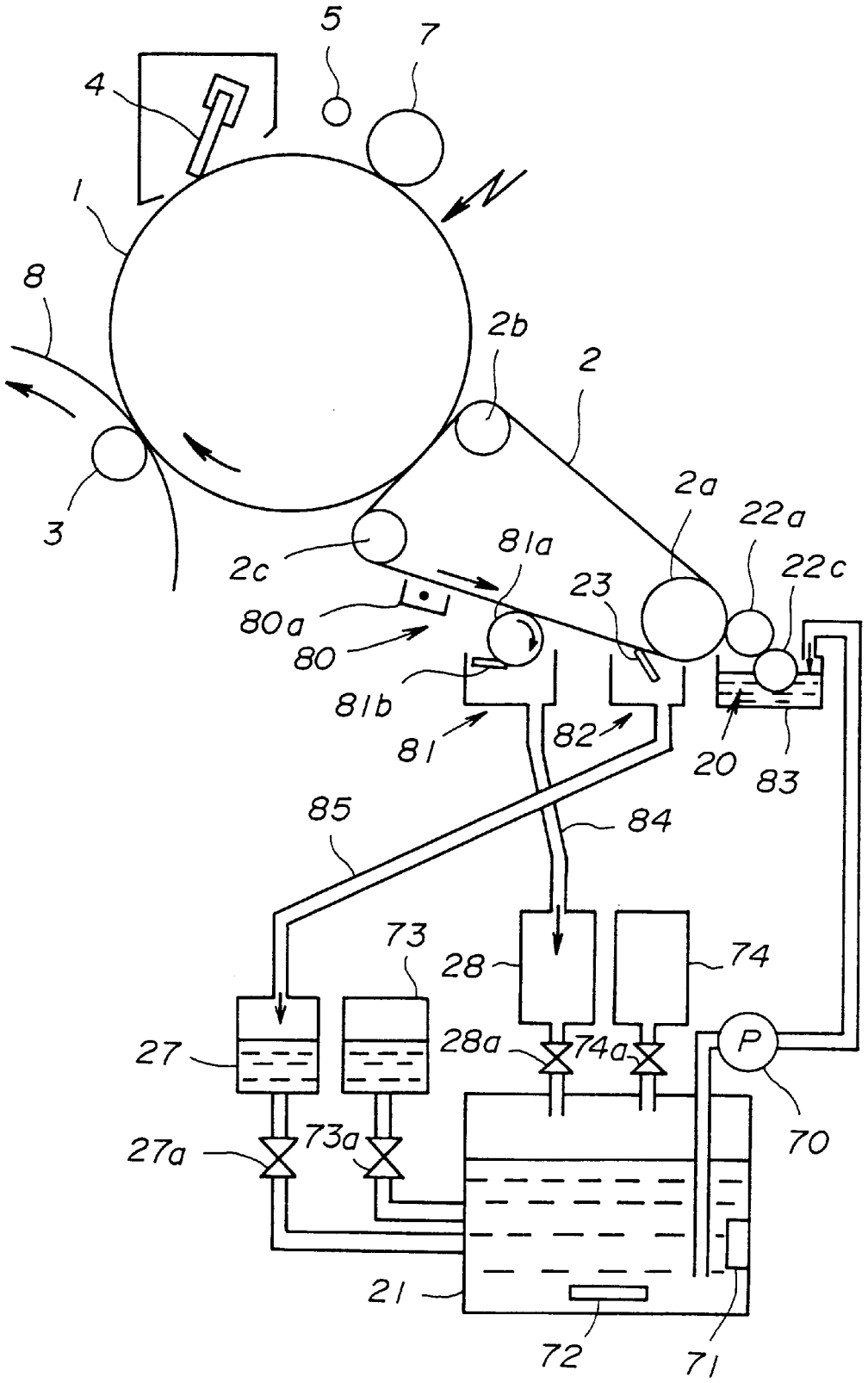
FIG. 20 shows a variation of the image forming apparatus of FIG. 19.

Referring to the image forming apparatus of FIG. 19, the liquid collected by the liquid removal unit 81 from the developing belt 2 may be supplied to the low-density developing liquid tank 73 as shown in FIG. 20, in case the liquid collected by the liquid collecting unit 81 from the developing belt 2 has toner components mixed therein and it is unfavorable to supply the collected liquid to the carrier liquid tank 28.

Figure 21:
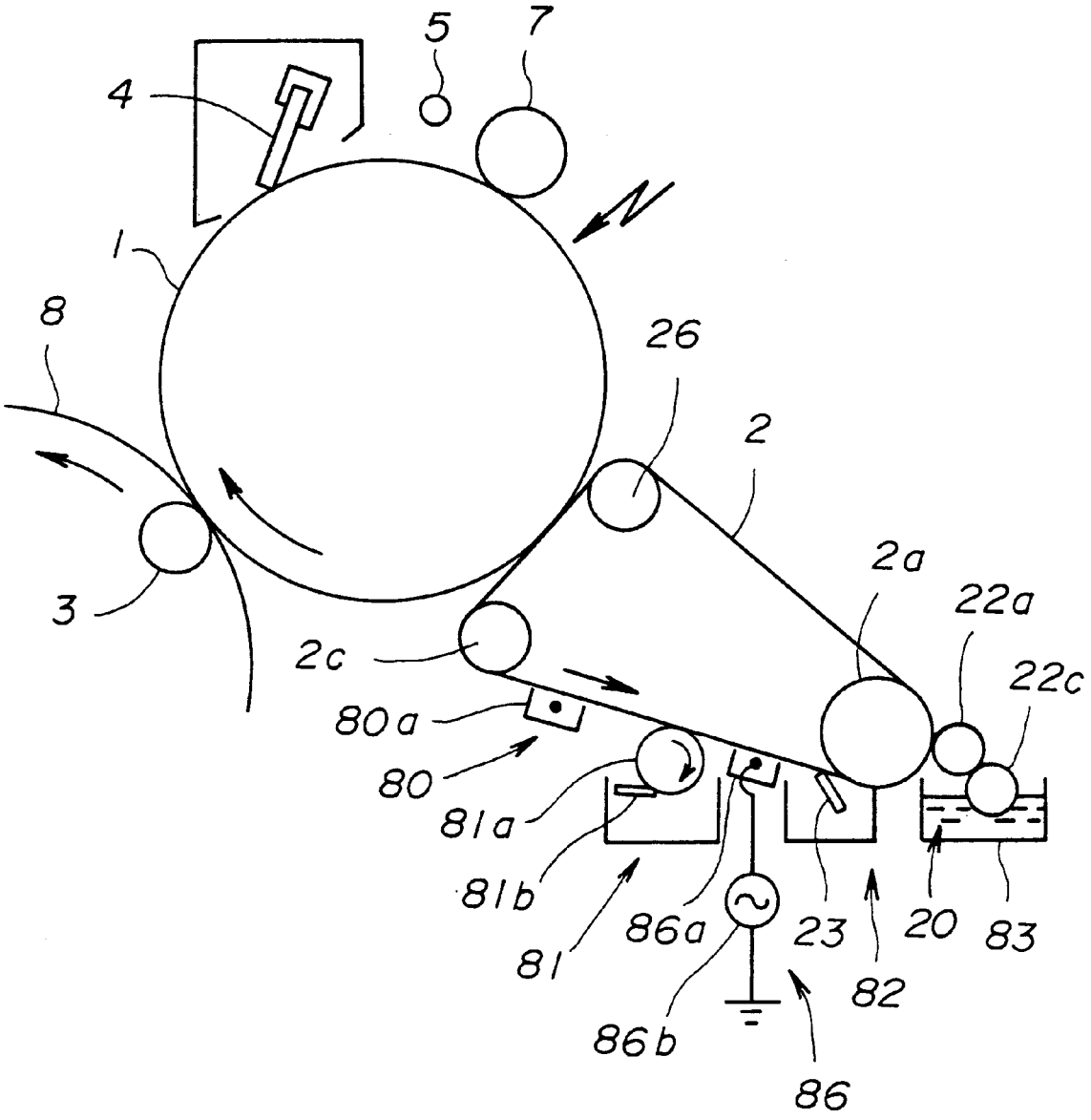
FIG. 21 shows a variation of the image forming apparatus of FIG. 18.

In case the particle aggregating unit 80 is embodied by a charging unit and it is deemed difficult for the toner collecting unit 82 to collect the toner from the developing belt 2, a discharging unit 86 may be provided upstream of the toner collecting unit 82 in the direction of the movement of the developing belt 2. As shown in FIG. 21, the discharger 86 may consist of a corona charger 86*a* and a power supply 86*b* for applying an ac voltage to the corona charger 86*a*. The power supply 86*b* may provide a voltage in which a dc voltage is superimposed on an ac voltage. Alternatively, the power supply 86*b* may provide only a dc voltage. Discharging of the developing liquid on the developing belt by the discharger 86 may be effective to prevent an abnormal image from occurring due to formation of toner aggregates when the toner collected by the toner collecting unit 82 returns to the developing liquid tank 21 so as to be re-distributed therein.

Figure 22:
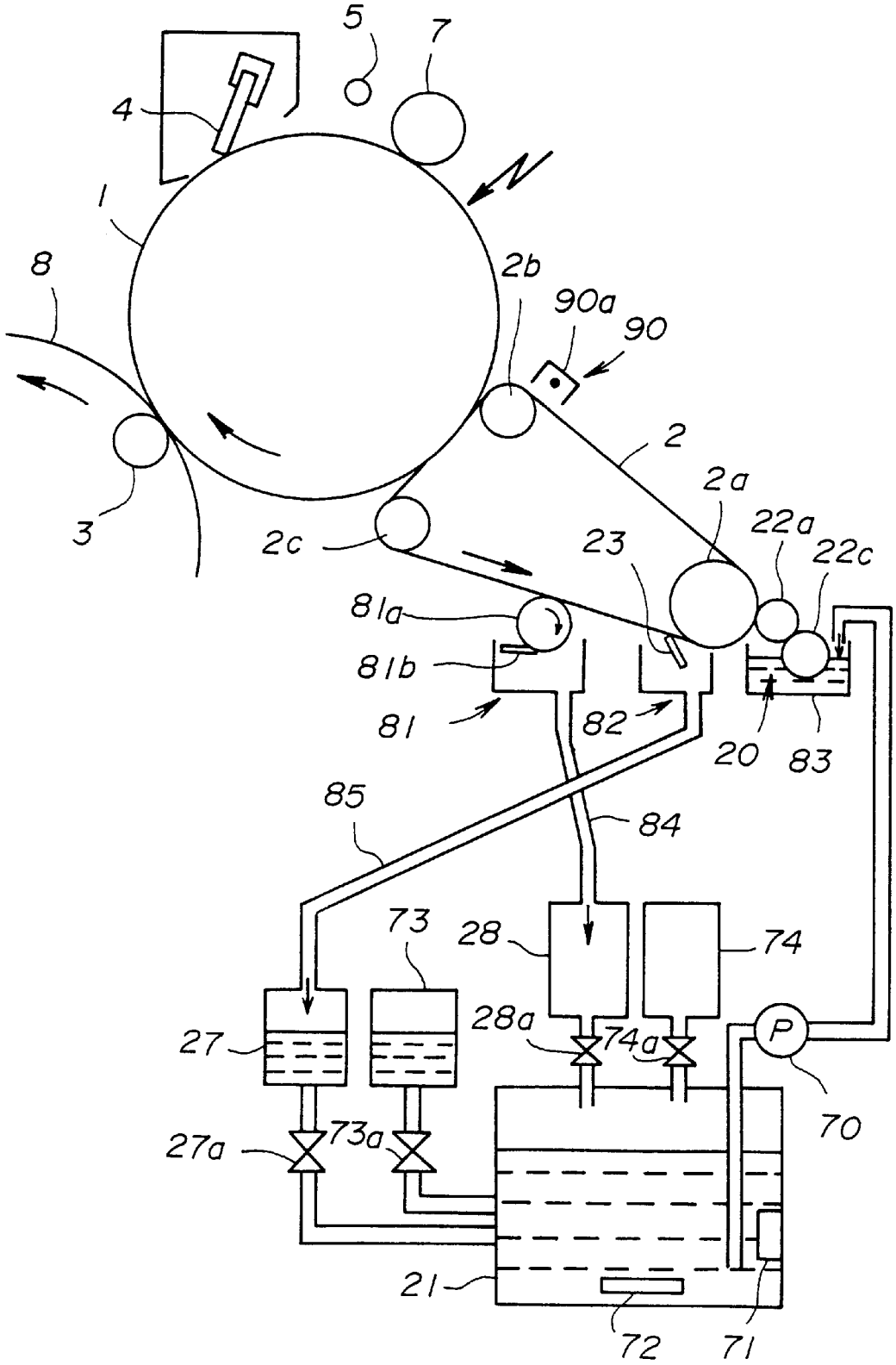
FIG. 22 shows a construction of an image forming apparatus according to a variation of the image forming apparatus of FIG. 20.

FIG. 22 shows a construction of an image forming apparatus according to a variation of the image forming apparatus of FIG. 20.

In the image forming apparatus of FIG. 22, a particle aggregating unit 90 is provided adjacent to the developing belt at a location upstream of the developing area. In accordance with this construction, the toner aggregated on the surface of the developing belt 2 maintains the aggregated status for a certain period of time. Thus, separation of the toner aggregate layer from the liquid layer on the developing belt 2 is maintained as far as a location opposite to the liquid removal unit 81 past the development area. In the image forming apparatus of FIG. 22, the toner remains aggregated in the development area. This has a favorable effect of preventing the background of the image from being stained.

A conductive member having a roller configuration and having a predetermined voltage applied thereto may be used to form an electric field with respect to a conductive base layer of the developing belt via which layer a bias potential is applied to the developing belt 2. In such an arrangement, the bias voltage is properly controlled so that the electric field attracts the toner having a desired charged polarity, thus causing the toner to be aggregated on the surface of the developing belt 2.

The present invention is not limited to the above described embodiments, and variations and modifications may be made without departing from the scope of the present invention.

What is claimed is:

1. A density regulating apparatus for regulating a density of developing liquid containing toner particles and carrier liquid for carrying the toner particles, comprising:

a rotatable container for containing the developing liquid; and a rotating unit for rotating said container, wherein said container when rotated generates a centrifugal force exerted on the developing liquid contained in said container.

2. The density regulating apparatus as claimed in claim 1, wherein said-container comprises a hollow cylindrical part, a front end plate and a rear end plate, said front end plate and said rear end plate closing said hollow cylindrical part.

3. The density regulating apparatus as claimed in claim 2, wherein an inlet through which the developing liquid is introduced into said container is provided so as to be aligned with a rotation axis of said container.

4. The density regulating apparatus as claimed in claim 2, wherein an outlet through which the developing liquid is drained out of said container is provided so as to be aligned with a rotation axis of said container.

5. The density regulating apparatus as claimed in claim 2, wherein an opening through which the toner particles pass is provided in said hollow cylindrical part of said container.

6. The density regulating apparatus as claimed in claim 2, wherein said hollow cylindrical part is formed of an elastic member provided with a plurality of incisions which produce respective openings when a predetermined elastic force is applied perpendicularly to a surface of said hollow cylindrical part, each of the openings having a size sufficient for the developing liquid to pass through.

7. A density regulating apparatus for regulating a density of developing liquid containing toner particles and carrier liquid for carrying the toner particles, comprising:

a pair of electrode plates provided so as to be opposite to each other and producing a potential difference in a gap between said pair of electrode plates, at least one of said pair of electrode plates being provided with conductivity and with a plurality of minute openings through the developing liquid passes, wherein the developing liquid is supplied to the gap between said pair of electrode plates.

8. The density regulating apparatus as claimed in claim 7, wherein a negative pressure with respect to a pressure occurring in the gap is applied to a surface of said at least one of said pair of electrode plates provided with conductivity and with the plurality of minute openings which surface is opposite to a surface facing another of said pair of electrode plates.

9. The density regulating apparatus as claimed in claim 8, wherein the negative pressure is simultaneously applied to the surface in a plurality of areas produced by segmenting said density regulating apparatus in a direction perpendicular to a direction in which the developing liquid flows.

10. An image forming apparatus comprising:

latent image carrying means;

latent image forming means for forming a latent image on said latent image carrying means;

developing liquid carrying means carrying a developing liquid containing toner particles and carrier liquid and transferring the developing liquid to said latent image carrying means having the latent image formed thereon;

collecting means for collecting the developing liquid from said developing liquid carrying means past a zone opposite to said latent image carrying means; and separating means for separating the developing liquid collected by said collecting means into a first portion and a second portion, the first portion containing one of relatively high-density developing liquid and genuine toner particles, and the second portion containing one of relatively low-density developing liquid and genuine carrier liquid.

11. The image forming apparatus as claimed in claim 10, wherein said separating means is provided with a rotatable container containing the developing liquid collected by said collecting means, the container when rotated generates a centrifugal force exerted on the developing liquid inside and causing the developing liquid to be separated into the first and second portions.

12. The image forming apparatus as claimed in claim 10, wherein said separating means comprises a pair of electrode plates provided so as to be opposite to each other and producing a potential difference in a gap between said pair of electrode plates, at least one of said pair of electrode plates being provided with conductivity and with a plurality of minute openings through the developing liquid passes, the developing liquid collected by said collecting means is supplied to the gap between said pair of electrode plates, and a potential difference is produced between the pair of electrode plates so that an electric field formed between said pair of electrode plates and exerted on the developing liquid causes the developing liquid to be separated into the first and second portions.

13. The image forming apparatus as claimed in claim 10, wherein said separating means includes an electrodeposition unit for causing the toner particles in the developing liquid to be aggregated on a surface of a member in contact with the developing liquid collected by said collecting means.

14. An image forming apparatus comprising:

latent image carrying means;

latent image forming means for forming a latent image on said latent image carrying means;

developing liquid carrying means carrying a developing liquid containing toner particles and carrier liquid and transferring the developing liquid to said latent image carrying means having the latent image formed thereon; and separating and collecting means for separating the developing liquid on said developing liquid carrying means past a zone opposite to said latent image carrying means into a first portion and a second portion, the first portion containing one of relatively high-density developing liquid and genuine toner particles, and the first portion containing one of relatively low-density developing liquid and genuine carrier liquid, and for collecting at least one of the first portion and the second portion.

15. The image forming apparatus as claimed in claim 14, wherein said separating and collecting means includes an electrode member provided so as to be opposite to said developing liquid carrying means past the zone opposite to said latent image carrying means and having a predetermined potential applied thereto, and an electric field generated between the electrode member and said developing liquid carrying means is exerted on the developing liquid on said developing liquid carrying means so as to separate the developing liquid into the first and second portions.

16. The image forming apparatus as claimed in claim 14, wherein said separating and collecting means includes a particle aggregating means for causing the toner particles in the developing liquid on said developing liquid carrying means past the zone opposite to said latent image carrying means to be aggregated on a surface of said developing liquid carrying means.

17. An image forming apparatus comprising:

latent image carrying means;

latent image forming means for forming a latent image on said latent image carrying means;

developing means for supplying developing liquid contained in a developing liquid containing part and including toner particles and carrier liquid, to said latent image carrying means on which the latent image is formed, so as to develop the latent image, and for collecting the developing liquid past a zone opposite to said latent image carrying means to the developing liquid containing part for re-use;

at least one of a prescribed-density developing liquid containing tank for retaining developing liquid having a solid content density as a desired solid content density of the developing liquid, a low-density developing liquid containing tank for containing developing liquid having a lower solid content density than the desired solid content density, a high-density developing liquid containing tank for containing developing liquid having a higher solid content density than the desired solid content density, and a carrier liquid containing tank for containing the liquid carrier;

liquid supply means for supplying liquid contained in said at least one of the prescribed-density developing liquid containing tank, the low-density developing liquid containing tank, the high-density developing liquid containing tank, to the developing liquid containing part;

separating and supplying means for separating the developing liquid past the zone opposite to said latent image carrying means into a first portion and a second portion, the first portion containing one of relatively high-density developing liquid and genuine toner particles, and the second portion containing one of relatively low-density developing liquid and genuine liquid carrier, and for supplying at least one of the first portion and the second portion to a respective one of the prescribed-density developing liquid containing tank, the low-density developing liquid containing tank, the high-density developing liquid containing tank and the liquid carrier containing tank.

18. The image forming apparatus as claimed in claim 17, wherein said separating and supplying means includes a rotatable container for containing the developing liquid past the zone opposite to the latent image carrying means, and the container when rotated generates a centrifugal force exerted on the developing liquid inside and causing the developing liquid to be separated into first and second portions.

19. The image forming apparatus as claimed in claim 17, wherein said separating and supplying means includes a pair of electrode members provided so as to be opposite to each other and having a predetermined potential applied thereto so as to produce an electric field between the pair of electrode plates, and the developing liquid past the zone opposite to said latent image carrying means is supplied to a gap between the pair of electrode members so that the electric field exerted on the developing liquid separates the developing liquid into the first and second portions.

20. The image forming apparatus as claimed in claim 17, wherein said separating and supplying means includes a particle aggregating unit for aggregating the toner particles in the developing liquid on a surface of a member in contact with the developing liquid past the zone opposite to said latent image carrying means.

21. The image forming apparatus as claimed in claim 17, wherein at least two of the prescribed-density developing liquid containing tank, the low-density developing liquid containing tank, the high-density developing liquid containing tank and the carrier liquid containing tank are provided, and the liquid supply means is constructed such that supply from the at least two of the prescribed-density developing liquid containing tank, the low-density developing liquid containing tank, the high-density developing liquid containing tank and the carrier liquid containing tank, to the developing liquid containing part is controlled independently.

22. The image forming apparatus as claimed in claim 17, wherein at least the high-density developing liquid containing tank and the low-density developing liquid containing tank are provided, and the liquid supply means is constructed so that the relatively high-density developing liquid is supplied to the high-density developing liquid containing tank and the relatively low-density developing liquid is supplied to the low-density developing liquid.

23. The image forming apparatus as claimed in claim 17, wherein at least the high-density developing liquid containing tank, the low-density developing liquid containing tank and the carrier liquid containing tank are provided, the developing liquid past the zone opposite to said latent image carrying means is separated into the relatively high-density developing liquid, the relatively low-density developing liquid and the genuine liquid carrier, and the liquid supply means is constructed so that the relatively high-density developing liquid is supplied to the high-density developing liquid containing tank, the relatively low-density developing liquid is supplied to the low-density developing liquid containing tank, and the genuine liquid carrier is supplied to the liquid carrier containing tank.

24. The image forming apparatus as claimed in claim 17, wherein the prescribed density developing liquid containing tank is provided, a detection unit for detecting an amount of developing liquid contained in the developing liquid containing part is coupled to the developing liquid containing tank, and the liquid supply means is constructed such that supply from the prescribed-density developing liquid containing tank to the developing liquid containing part is controlled in accordance with a result of detection by the detection unit.

25. An image forming apparatus comprising:

latent image carrying means;

latent image forming means for forming a latent image on said latent image carrying means;

developing means for supplying developing liquid contained in a developing liquid containing part and including toner particles and carrier liquid, to said latent image carrying means on which the latent image is formed, so as to develop the latent image, and for collecting the developing liquid past a zone opposite to said latent image carrying means to the developing liquid containing part for re-use;

a high-density developing liquid containing tank for containing developing liquid having a higher solid content density than a desired solid content density of the developing liquid in the developing liquid containing part;

a prescribed-density developing liquid containing tank for containing developing liquid having a solid content density closer to a desired solid content density than the developing liquid contained in the high-density developing liquid tank, or having a solid content density equal to the desired solid content density; and liquid supply means for independently supplying liquid contained in said high-density developing liquid containing tank and the prescribed-density developing liquid containing tank, to the developing liquid containing part.

* * * * *